US007116293B2

(12) United States Patent
Numao

(10) Patent No.: US 7,116,293 B2
(45) Date of Patent: Oct. 3, 2006

(54) EMITTER, EMITTING DEVICE, DISPLAY PANEL, AND DISPLAY DEVICE

(75) Inventor: Takaji Numao, Kashiwa (JP)

(73) Assignee: Sharp Kabushiki Kaisha, Osaka (JP)

( * ) Notice: Subject to any disclaimer, the term of this patent is extended or adjusted under 35 U.S.C. 154(b) by 763 days.

(21) Appl. No.: 09/876,584

(22) Filed: Jun. 7, 2001

(65) Prior Publication Data

US 2001/0054711 A1 Dec. 27, 2001

(30) Foreign Application Priority Data

Jun. 7, 2000 (JP) ..... 2000-171246

(51) Int. Cl.
*G09G 3/32* (2006.01)

(52) U.S. Cl. ..... 345/82; 345/76; 315/169.3

(58) Field of Classification Search ..... 345/76, 345/82, 45–46; 315/169.1, 169.3, 169.4
See application file for complete search history.

(56) References Cited

U.S. PATENT DOCUMENTS

| | | | | |
|---|---|---|---|---|
| 4,087,792 | A * | 5/1978 | Asars | 345/77 |
| 5,714,968 | A | 2/1998 | Ikeda | |
| 5,793,163 | A * | 8/1998 | Okuda | 315/169.2 |
| 6,072,450 | A * | 6/2000 | Yamada et al. | 345/76 |
| 6,307,324 | B1 * | 10/2001 | Hirano et al. | 315/169.3 |
| 6,373,454 | B1 * | 4/2002 | Knapp et al. | 345/76 |
| 6,421,034 | B1 * | 7/2002 | Mihara | 345/76 |
| 6,529,178 | B1 * | 3/2003 | Kimura | 345/76 |

FOREIGN PATENT DOCUMENTS

| | | |
|---|---|---|
| JP | 05-070773 | 3/1993 |
| JP | 05-198377 | 8/1993 |
| JP | 06-172751 | 6/1994 |
| JP | 08-054836 | 2/1996 |
| JP | 08-234683 | 9/1996 |
| JP | 09-232074 | 9/1997 |
| JP | 10-268798 | 10/1998 |
| JP | 11-272235 | 10/1999 |

OTHER PUBLICATIONS

*Development of Multi-Color Organic EL Display*, T. Kusaka et al., NEC Technical Journal, vol. 51, No. 10/1998, Oct. 23, 1998, pp. 28-32.

*Development of Drive Circuitry for an Organic EL Dot-Matrix Display*, (Y. Okuda et al., PIONEER R&D vol. 8, No. 3, Dec. 31, 1998, pp. 41-49.

*L2.3: Organic Multicolor EL Display With Fine Pixels*, (C. Hosokawa et al., SID 97 DIGEST, 1997, pp. 1073-1076.

* cited by examiner

*Primary Examiner*—Richard Hjerpe
*Assistant Examiner*—Kimnhung Nguyen
(74) *Attorney, Agent, or Firm*—David G. Conlin; Steven M. Jensen; Edwards Angell Palmer & Dodge LLP

(57) ABSTRACT

Each pixel of an EL display panel includes a diode element, an organic EL element, and a capacitor. The cathode of the diode element, the anode of the organic EL element, and one of the electrodes of the capacitor are electrically connected to one another at a common terminal. The anode of the diode element is connected to a signal electrode. The other electrode of the capacitor is connected to a scanning electrode. The cathode of the organic EL element is connected to the scanning electrode. A forward direction of the diode element and a forward direction of the organic EL element coincide. The voltage between the scanning electrodes is controlled to control the current flowing through the organic EL element. As a result, it is possible to provide an emitter having stable luminance with improved efficiency, and an emitting device and a display panel employing such an emitter.

22 Claims, 32 Drawing Sheets

EMITTER, EMITTING DEVICE, DISPLAY PANEL, AND DISPLAY DEVICE

FIELD OF THE INVENTION

The present invention relates to an emitter, an emitting device, a display panel, and a display device which employ self-emitting emitting elements such as a thin-film EL (Electro Luminescence) or an FED (Field Emission Device).

BACKGROUND OF THE INVENTION

Display panels employing a self-emitting emitting element, as represented by an organic EL (Electro Luminescence) display panel or an FED, have a promising future as a candidate for a flat display panel which can match up against liquid crystal displays.

FIG. 19(*a*) and FIG. 19(*b*) show structures of a blue-color emitting organic EL element which was introduced in the SID 97 DIGEST pp. 1073–1076. FIG. 19(*a*) is a cross sectional view showing a structure of a conventional blue-color emitting organic EL element 311, and FIG. 19(*b*) is a structural formula of an emitting layer 307 of FIG. 19(*a*).

The blue-color emitting EL element 311 has a structure in which a transparent anode (transparent electrode) 302 such as ITO is formed on a glass 301, and an organic multi-layered film 304 is formed thereon. On the organic multi-layered film 304 is formed a cathode 303 such as Al. Among several structures of the organic multi-layered film 304 the foregoing publication adopts a structure in which a hole injecting layer 305, a hole transporting layer 306, an emitting layer 307, and an electron transporting layer 308 are stacked on the anode 302. Further, the foregoing publication discloses a structure for realizing full-color display by subjecting the monochromatic blue color luminescence to color-conversion with the use of a color-conversion filter. The emitting layer 307 has such a structure with the structural formula (biphenyl (DPVBi: provided by Idemitsu Kousan Co., Ltd.)) as shown in FIG. 19(*b*).

FIG. 20 is a structure of a conventional emitting organic EL element of three colors R, G, and B, as taught by NEC TECHNICAL JOURNAL Vol. 51 No. 10/1998 pp.28–32 (published date: Oct. 23, 1998), showing a cross sectional view of a pixel structure of the emitting organic EL element of three colors R, G, and B. Note that, in FIG. 20, structural elements which are analogous to those shown in FIG. 19(*a*) are given the same reference numerals. On a glass 301 is formed a transparent anode 302 such as ITO (the structure is upside down in FIG. 20), and an organic multi-layered film 304 is formed thereon. On the organic multi-layered film 304 is formed a cathode 303 such as Al. Among several structures of the organic multi-layered film 304, the foregoing publication adopts a structure in which a hole transporting layer 306, an emitting layer 307, and an electron transporting layer 308 are stacked on the anode 302. Further, in this publication, a hole injecting layer (not shown) and the hole transporting layer 306 are made of an aromatic amine material. That is, Further, in the emitting layer 307, a red emitting layer 307R is made of a G (green) emitting material as a host doping a pigment DCM for a red (R) laser, and a green emitting layer 307G and a blue emitting layer 307B are made of an aromatic amine material. The electron transporting layer 308 is made of a metal complex material.

Various other materials for the organic multi-layered film 304 can be found in many Japanese Unexamined Patent Publications, including, for example, Tokukaihei 5-70773 (published date: Mar. 23, 1993), Tokukaihei 5-198377 (published date: Aug. 6, 1993), and Tokukaihei 6-172751 (published date: Jun. 21, 1994).

FIG. 21 is a perspective view showing a structure of a simple-matrix-type EL panel (EL display panel) using such an organic EL element. Specifically, a plurality of anodes 2 extending in one direction and the cathodes 3 extending in a direction orthogonal to the anodes 2 are formed on a glass 1 with the organic multi-layered film 4 therebetween, thus making the simple-matrix-type EL panel, with the areas of intersections of the anodes 2 and the cathodes 3 making up pixels.

FIG. 22 is a graph showing a relation between a voltage between the cathode 303 and the anode 302 (cathode-anode voltage) and a current through the emitting layer 307 in the organic EL element as shown in FIG. 19 and FIG. 20. Also, FIG. 23 is a graph showing a relation between a current through the emitting layer 307 and luminance. As shown in FIG. 23, in the organic EL element, the current through the emitting layer 307 and the luminance are nearly proportionally related, which, however, is not the case for the relation between the cathode-anode voltage and the current through the emitting layer 307, which varies depending on such factors as temperature, as shown in FIG. 22.

Thus, the organic EL element is preferably driven by controlling current, rather than voltage, to stabilize luminance. As such is the case, the column (data) driver circuit for driving the organic EL element preferably has a structure as shown by a current-controlling driver circuit 116 in FIG. 24. FIG. 24 is a block diagram showing a structure of the matrix-type EL panel.

Here, the current-controlling driver circuit 116 is structured such that the voltage generated by the column driver circuit 112 is converted to current by a current control circuit (variable constant current circuit) 115. Apart from the question as to whether such a structure is preferable or not, the use of a current-controlling driver circuit is nonetheless preferable in the organic EL element.

In this structure, the current-controlling driver circuit 116 is connected to the anodes 2 of the EL panel 110 (as shown in FIG. 2), and a row (scanning) driver circuit 111 is connected to the cathodes 3, thus structuring the matrix-type EL panel. Note that, the column driver circuit 112 has a structure wherein a shift register 113 receives data according to luminance of respective colors R, G, and B (red, green, and blue), which are then transferred by a clock CLK and held in a sample hold circuit 114 by a data hold timing pulse LP, and a current is outputted from the current control circuit 115 based on this data.

A driving method of such a matrix-type EL panel of a simple matrix structure is disclosed in PIONEER R&D Vol. 8 No. 3, pp.41–49 (published date: Dec. 31, 1998). The following describes a driving method of the simple-matrix-type EL panel with reference to FIG. 25. FIG. 25 is a circuit diagram showing a driving circuit of the simple-matrix-type EL panel.

The potential of a selected row (scanning) electrode K2 is dropped to a GND potential, and the other row electrodes are set to a specific potential (here, about 10 V). Display is carried out in such a manner that constant currents are flown through column (data) electrodes A2 and A3 of their respective pixels $E_{2,2}$ and $E_{2,3}$ to be displayed, and the column electrodes which correspond to pixels not to emit light are set to an open state.

Further, in order to carry out multi-tone display on pixels, the current supplied from the column electrode is controlled according to a tone level to be displayed on the pixel. This current control is carried out by (1) a current value modulation tone control method, in which the intensity of the current outputted to the column electrodes (anodes 2 in FIG. 24) from the current control circuit 115 is changed according to the luminance of pixels to be displayed, and (2) a pulse width modulation tone control method, in which a supply time of a current is changed according to the luminance of pixels to be displayed, while holding the currents outputted to the column electrodes at a constant level.

Meanwhile, a structure of an active-matrix-type EL panel using diodes is shown, for example, in Tokukaihei 10-268798 (published date: Oct. 9, 1998).

FIG. 26 shows an equivalent circuit of a pixel of the EL panel of this publication. FIG. 26 is a circuit diagram showing an equivalent circuit of the active-matrix-type EL panel using diodes. A pixel 12 includes an organic EL element 13, an additional capacitance (auxiliary capacitance) 14, an additional resistance 15, and an MIM (Metal Insulator Metal) diode 16 as the pixel driving element.

The pixel 12 of the EL panel has a structure as shown in FIG. 27(*a*) and FIG. 27(*b*), in which FIG. 27(*a*) is a plan view showing the structure of the pixel 12 of FIG. 26, and FIG. 27(*b*) is a cross sectional view, taken along the line A—A of FIG. 27(*a*). The MIM diode 16 has a stacked structure of a cathode electrode 21 made of tantalum, an insulating film 22 made of a silicon oxide film, and an anode electrode 23 made of chrome, and is formed on an insulating substrate 31. The additional resistance 15 is made up of a wiring layer which is formed on the insulating substrate 31, making up a portion of the anode electrode 23 of the MIM diode 16 extending on the insulating substrate 31.

The additional capacitance 14 is composed of electrodes 41 and 42 opposing each other, and an insulating film 43. The electrode 41, made of tantalum, is formed on the insulating substrate 31. On the electrode 41 is formed the electrode 42, made of chrome, via the insulating film 43 made of a silicon oxide film. Further, the electrode 42 is connected to the wiring layer making up the additional capacitance 15. Here, the electrode 41 is formed simultaneously with the cathode electrode 21 of the MIM diode 16, and the electrode 42 is simultaneously formed with the anode electrode 23 of the MIM diode 16, and the insulating film 43 is simultaneously formed with the insulating film 22 of the MIM diode 16.

The organic EL element 13 has a stacked structure of an anode 51 made of a transparent electrode such as ITO, a hole transporting layer 52, an emitting layer 53, an electron transporting layer 54, and a cathode 55 made of aluminium alloy. The hole transporting layer 52, the emitting layer 53, and the electron transporting layer 54 are made of organic compounds. The cathode 55 is formed on the electrode 42 making up the additional capacitance 14, via the insulating film 56 made of a silicon oxide film. Further, the cathode 55 is connected to the anode electrode 23 of the MIM diode 16 via a contact hole 57 which is formed through the insulating film 56. The anode 51 is connected to the electrode 41 of the additional capacitance 14 via a contact hole 58 which is formed through the insulating film 43 and the insulating film 56.

A structure of the foregoing EL panel and a driving system of the EL panel is shown in FIG. 28. FIG. 28 is a block diagram showing a structure of the active-matrix-type EL panel using diodes.

An EL display device 84 includes an EL panel 81, a gate driver 82, and a drain driver (data driver) 83. On the EL panel 81 are disposed gate wires (scanning lines) $G_1, \ldots, G_n, G_{n+1}, \ldots, G_m$, and drain wires (data lines) $D_1, \ldots, D_n, D_{n+1}, \ldots, D_m$. The gate wires $G_1$ through $G_m$ and the drain wires $D_1$ through $D_m$ are orthogonal to each other, and the areas where they cross each other make up pixels 12. That is, the EL panel 81 is made up of the pixels 12 which are disposed in a matrix pattern. The gate wires $G_1$ through $G_m$ are connected to the gate driver 82 for receiving gate signals (scanning signals). Further, the drain wires $D_1$ through $D_m$ are connected to the drain driver 83 for receiving data signals.

Here, the gate wires $G_1$ through $G_m$ are made up of cathode electrodes 21 of the MIM diode 16. Further, the drain wires $D_1$ through $D_m$ are made up of electrodes 41 of the additional capacitance 14 extending on the insulating substrate 31 (FIG. 27(*a*) and FIG. 27(*b*)).

The following describes a driving method of the EL panel 84 with reference to FIG. 26 through FIG. 28. By controlling the voltage of the gate wire $G_n$ so that the voltage between the gate wire $G_n$ and the drain wire $D_n$ becomes higher than the threshold voltage of the MIM diode 16, the MIM diode 16 becomes conducted. This sets off charging the electrostatic capacitance of the organic EL element 13, and the additional capacitance 14 by the data signal applied to the drain wire $D_n$, thus applying the data signal to the pixel 12. This data signal drives the organic EL element 13, and the organic EL element 13 emits light as a result.

On the other hand, when the voltage of the gate wire $G_n$ is controlled so that the voltage between the gate wire $G_n$ and the drain wire $D_n$ becomes lower than the threshold voltage of the MIM diode 16, the MIM diode 16 becomes non-conducted. In this case, the data signal which had been applied to the drain wire $D_n$ up to this time is held in the form of a charge by the electrostatic capacitance of the organic EL element 13, and the additional capacitance 14. By thus supplying data signals to be applied to the pixels 12 to the drain wires $D_1$ through $D_m$, and by controlling the voltages of the gate wire $G_1$ through $G_m$, any data signal can be held by the pixels 12. The organic EL element 13 can be driven continuously, i.e., can emit light, until the MIM diode 16 becomes non-conducted again.

Further, a structure of the active-matrix-type EL panel using a FET (Field Effect Transistor), or, in particular, a thin film transistor (TFT) is shown, for example, in Tokukaihei 8-234683 (published date: Sep. 13, 1996).

An equivalent circuit of the EL panel as disclosed in this publication is shown in FIG. 29. FIG. 29 is a circuit diagram showing an equivalent circuit of pixels of the EL panel of the active-matrix-type EL panel using TFTs. A two-dimensional structure of pixels of the EL panel is as shown in FIG. 30. FIG. 30 is a plan view of pixels of the active-matrix-type EL panel using TFTs.

Each pixel 212 of the EL panel includes two TFTs 213 and 214, a memory capacitor 215, and an organic EL element 216. The source of the TFT 213 is connected to a source bus (column electrode, source line 152), and the gate of the TFT 213 is connected to a gate bus (row electrode, gate line 151). To the drain of the TFT 213 are connected in parallel one of the terminals of the memory capacitor 215 and the gate of the TFT 214. The other terminal of the memory capacitor 215 and the source of the TFT 214 are connected to a ground pass 153, and the drain of the TFT 214 is connected to the anode (EL anode layer 418) of the organic EL element 216. The cathode of the organic EL element 216 is connected to a negative power source (not shown).

The TFT 214 and the memory capacitor 215 of the EL panel as shown in FIG. 30 has cross sectional structures as shown in FIG. 32 and FIG. 33, respectively. FIG. 32 is a cross sectional view taken along the line B—B of FIG. 30, and FIG. 33 is a cross sectional view taken along the line C—C of FIG. 30. The TFT 214 and the memory capacitor 215 are fabricated as follows.

A polysilicon layer 411 is deposited on a transparent insulating substrate 410 made of a material such as crystal or low-temperature glass, and the polysilicon layer 411 is patterned in the form of an "island" by photolithography. Then, an insulating gate material 412 such as silicon dioxide is deposited in the thickness of about 1000 Å on the surfaces of the polysilicon layer 411 of the island shape and the insulating substrate 410.

Then, a polysilicon layer 413 made of amorphous silicon is deposited on the gate insulating layer 412, and is patterned by photolithography on the polysilicon island so that source and drain areas are formed in the polysilicon area after ion implantation. The ion implant is conducted with an N-type dopant, for which arsenic is used. The polysilicon gate electrode 413 also serves as a base electrode 413*a* of the capacitor 215. The gate bus 414 is made of metal silicides such as tungsten silicide ($WSi_2$) and is patterned.

Thereafter, an insulating layer 415 such as silicon dioxide is deposited over the entire surface of the device. A portion of the insulating layer 415 is used to form contact holes 416*a* and 417*a*, etc., so as to provide a junction in the thin film transistor. An electrode material 416, which is provided in contact with the source area of the TFT 214, also makes up an upper electrode 416*b* of the capacitor 215. The source bus and the ground bus are also formed on the insulating layer 415. The EL anode layer (transparent electrode) 418 made of a material such as ITO is in contact with the drain area of the TFT 214, and makes up an anode of the organic EL element 216.

Then, an insulating passivation layer 419 such as silicon dioxide is deposited on the surface of the device in the thickness of about 0.5 μm to about 1 μm. The passivation layer 419 is tapered toward an edge 420 on the side of the ITO. The organic EL layer 421 is deposited on the passivation layer 419 and the EL anode layer 418. Finally, the cathode 422 of the organic EL element 216, which is made of a metallic material such as aluminium is deposited on the surface of the device.

The organic EL layer 421 is available in several different structures. For example, the foregoing Tokukaihei 8-234683 discloses a structure of organic EL layer 421 which includes organic hole injection and a moving band in contact with an anode, and electron injection and a moving band for forming a junction with the organic hole injection and the moving band. The Tokukaihei 8-234683 also discloses a structural formula of such an organic layer.

The foregoing circuit operates in the following manner. A voltage for switching ON the TFT 213 is applied to the gate line 151. Then, the TFT 214 is switched ON while accumulating the supplied charge from the source line 152 in the memory capacitor 215. The conduction state of the TFT 214 is also controlled by the stored charged in the memory capacitor 215, even after the TFT 214 is switched OFF, so as to control the current flow through the organic EL element 216.

FIG. 23 shows that the luminance of the organic EL element is nearly proportional to the current. In relation to this, the applied voltage to the organic EL element is related to luminance or luminous efficiency as shown in FIG. 31. FIG. 31 is a graph showing a relation between the applied voltage to the organic EL element, and luminance or luminous efficiency.

The luminous efficiency is determined as follows. Luminance L of the organic EL element and current I through the organic EL element are related by $$L=A(I)\times I$$

(where A(I) is a function which approaches zero when current I is small, and which takes a constant value when current I exceeds a certain value). Further, power consumption W of the organic EL element is related to applied voltage V and current I by $$W=V\times I.$$

Thus, luminous efficiency L/W of the organic EL element is $$L/W=(A(I)\times I)/(V\times I)=A(I)/V \quad (1).$$

For example, as shown in FIG. 31, the luminous efficiency L/W takes the value 22 [lm/W] at the applied voltage of 3 [V], at which the luminance is 100 [cd/m$^2$]. Further, the luminous efficiency is 15.5 [lm/W] at the applied voltage of 4.4 [V], at which the luminance is 1000 [cd/m$^2$]. This behavior wherein the luminous efficiency L/W once increases with increase in potential V and then decreases can be explained by the function A(I), which shows an abrupt increase with increase in current I up to a certain current I, and which takes almost a constant value above this current I. Further, it can be speculated that the luminous efficiency L/W shows the maximum value in the vicinity of where the function A(I) takes almost a constant value.

In the structure of the simple-matrix-type EL panel, when the number of scanning lines is m, the duration of emission of the organic EL element making up the pixel is only 1/m of the total scanning period. Thus, in order to obtain the same luminance in this pixel as that of a device of a constant-luminescence-type, each duration of emission needs to show spontaneous luminance m times that of the constant-luminescence-type device.

In general, the luminance of white display in laptop personal computers, etc., is around 100 [cd/m$^2$]. Thus, when the number of scanning lines is 100 or more, the required spontaneous luminance for the pixel exceeds 10000 [cd/m$^2$].

However, in the currently available organic EL elements, as shown in FIG. 31, the spontaneous luminance (luminance L) at which the luminous efficiency L/W becomes maximum is around 10 to 100 [cd/m$^2$]. Thus, when such an organic EL element is to be used in a display with the number of scanning lines exceeding 100, the organic EL element needs to be used at low luminous efficiency L/W in the simple-matrix-type EL panel.

In view of this drawback, the active-matrix-type EL panel using diodes as disclosed in the foregoing Tokukaihei 10-268798, and the active-matrix-type EL panel using FETs as disclosed in the foregoing Tokukaihei 8-234683 intended to increase the duration of emission of the organic EL element larger than 1/m of the total scanning period.

However, in the equivalent circuit as shown in FIG. 26, which is the EL panel using diodes, the equivalent circuit will be in the form of an RC serial circuit (resistance-capacitance serial circuit) when the MIM diode 16 becomes non-conducted. Here, the capacitance (capacitance value C) corresponds to the additional capacitance 14 of FIG. 26, and the resistance (resistance value R) presumably corresponds to the sum of the additional resistance 15 (resistance value r) of FIG. 26 and the internal ON resistance of the organic EL element 13 during conduction.

The current I(t) through the organic EL element 13 is $$I(t)=(q_o/RC)\exp(-t/RC) \quad (2)$$

(where t is the elapsed time from the beginning of the non-conduction state of the MIM diode 16, and $q_o$ is the charge held in the additional capacitance 14 when time t=0). The charge $q_o$ held in the additional capacitance 14 and the voltage $V_o$ generated in the additional capacitance 14 are related by $$V_o=q_o/C.$$

In order to improve luminous efficiency over the simple-matrix-type panel, assuming that the voltage $V_o$ is decided by the withstand voltage of the source driver, it can be seen from equation (1) that the peak value of current I(t) (current $I(0)=V_o/R$ when t=0) needs to be reduced. This requires that the resistance value r of the additional resistance 15 be increased. Note that, since luminance is decided by charge (charge=current value×discharge time at this current value), the luminance will not be changed even when the current is decreased, as long as the discharged charge is constant (because the discharge time is usually short).

However, when the resistance value r of the additional resistance 15 is increased, the time constant RC of the equivalent circuit of FIG. 26 is increased as well. This causes the problem of increased time period for charging the additional capacitance 14. This problem can be solved by increasing the voltage supplied from the source driver, which, however, requires the source driver to have a high withstand voltage, and causes another problem of increased cost of the source driver.

Further, comparing the charging by decreasing the resistance value of the additional resistance 15 and the voltage supplied from the source driver, with the charging by increasing the resistance value of the additional resistance 15 and the voltage supplied from the source driver, the intensity of the current I(t) and the way it flows will be the same between these two methods, provided that the stored charge in the capacitance (capacitance value C) and the charging time are both constant. Since the calorific value of the additional resistance 15 is decided by the product of the square of current and the resistance value, the problem of calorific value in the charging time will be caused as the resistance value is increased.

Further, in this case, the current I(t) through the organic EL element 13 shows an exponential change. Thus, the high luminous efficiency state of the organic EL element 13 cannot be maintained constantly, and further, the low luminous efficiency state may be caused by the change in current I(t). Thus, it is difficult to sufficiently improve the luminous efficiency as with the foregoing case.

Increasing the additional resistance also poses a problem in particular that the generated heat by the current flow through the additional resistance 15 during the charging/discharging period of the additional capacitance C does not contribute to luminescence.

Meanwhile, the active-matrix-type EL panel using TFTs has the following problems. In the active-matrix-type EL panel, the threshold characteristics between the gate and source of the TFT 214 in the equivalent circuit of FIG. 29 do not become uniform within the panel and there is a variance. This variance further causes a variance in a voltage drop between the source and drain, or between the gate and drain, which results in variance in luminance of the organic EL element 216 in the panel.

Further, in this case, the organic EL element 216 is driven by voltage control. Thus, compared with the foregoing case where the organic EL element 216 is driven by current control, luminance becomes instable.

Further, in the case where the organic EL element 216 is displaying tones under the control of the gate voltage of the TFT 214, the current flow through the organic EL element 216 is varied according to the tone level. As a result, the luminous efficiency of the organic EL element 216 is changed according to tones, failing to drive the organic EL element 216 by the current of a range which intends to increase luminous efficiency. Thus, it is also difficult in this case to sufficiently improve luminous efficiency.

SUMMARY OF THE INVENTION

The present invention was made to solve the foregoing problems, and it is an object of the present invention to provide an emitter which has stable luminance while improving luminous efficiency, and an emitting device, a display panel, and a display device using the same.

In order to achieve the foregoing object, an emitter of the present invention includes: an active element, having a first terminal and a second terminal, which is adapted to switch between the first terminal and the second terminal; an diode emitting element having a first terminal and a second terminal; and a capacitor having a first terminal and a second terminal, wherein: the respective first terminals of the active element, the diode emitting element, and the capacitor are electrically connected to one another, and potentials are individually set for the respective second terminals of the active element, the diode emitting element, and the capacitor, while controlling a switching operation of the active element.

With this arrangement, by the application of a predetermined potential difference between the second terminal of the capacitor and the second terminal of the active element while the active element is in a conduction state, the capacitor can store a predetermined amount of charge (selected period).

Further, by varying a potential difference between the second terminal of the capacitor and the second terminal of the diode emitting element so as to discharge the stored charge in the capacitor while the active element is in a non-conduction state, the diode emitting element can emit light according to the amount of stored charge in the capacitor (non-selected period). Note that, in order to vary the potential difference between the second terminal of the capacitor and the second terminal of the diode emitting element, for example, the respective potentials of the second terminals are converged to an equal potential.

By successively carrying out the foregoing operation, the quantity of light emitted by the diode emitting element can be decided according to the potential difference (or a current which is flown by the potential difference) which is applied when charging the capacitor. Thus, the foregoing arrangement allows luminescence in tones.

By this tone luminescence according to the amount of charge which flows through the diode emitting element, the stability of luminance with respect to such factors as temperature can be improved compared with the case where light is emitted in tones by controlling the applied voltage to the diode emitting element.

Here, when charging the capacitor, the amount of stored charge can also be controlled, if the variance in capacitance of the capacitors is small, by accurately controlling, for example, the potential between the second terminal of the capacitor and the second terminal of the active element. This realizes accurate tone luminescence.

Note that, even when the variance in capacitance of the capacitors is large, for example, by controlling a potential between the second terminal of the capacitor and the second terminal of the active element by monitoring the current flow between the two terminals when charging the capacitor, the amount of stored charge can be accurately controlled. This realizes tone luminescence more accurately.

Further, when the diode emitting element is emitting light, the current which flows through the diode emitting element can be controlled by controlling a change in potential difference between the second terminal of the capacitor and the second terminal of the diode emitting element. That is, when the diode emitting element emits light by drawing the charge stored in the capacitor in the form of a current, the current flow can be controlled. This allows a current flow which would increase luminous efficiency, and the diode emitting element can emit light with high efficiency. Thus, luminous efficiency of the diode emitting element can be improved.

Here, the emission of the diode emitting element can be stopped by further controlling the potential of the second terminal of the diode emitting element with respect to the potential of the second terminal of the active element. This prevents a current flow which would cause luminescence of the diode emitting element with low luminous efficiency through the diode emitting element, when charging the capacitor.

Further, the foregoing arrangement does not especially require an additional resistance for controlling the current flowing through the diode emitting element. Thus, it is possible to prevent increase in time constant when charging the capacitor, and thus reducing the charging time. Further, it is possible to suppress heat generation due to the current flow through the additional resistance, or decrease in luminous efficiency due to the generated heat.

As described, the emitter having the foregoing arrangement can improve luminous efficiency of the diode emitting element, and suppress increase in time constant when charging the capacitor, and emit light in tones both accurately and stably.

For a fuller understanding of the nature and advantages of the invention, reference should be made to the ensuing detailed description taken in conjunction with the accompanying drawings.

BRIEF DESCRIPTION OF THE DRAWINGS

FIG. 3(*b*) shows a non-selected state 1; and FIG. 3(*c*) shows a non-selected state 2.

FIG. 7(*b*) shows a non-selected state 1; and FIG. 7(*c*) shows a non-selected state 2.

FIG. 11(*b*) shows a non-selected state 1; and FIG. 11(*c*) shows a non-selected state 2.

FIG. 15(*b*) shows a non-selected state 1; and FIG. 15(*c*) shows a non-selected state 2.

DESCRIPTION OF THE EMBODIMENTS

The following will describe embodiments of the present invention with reference to FIG. 1 through FIG. 19.

Figure 17:
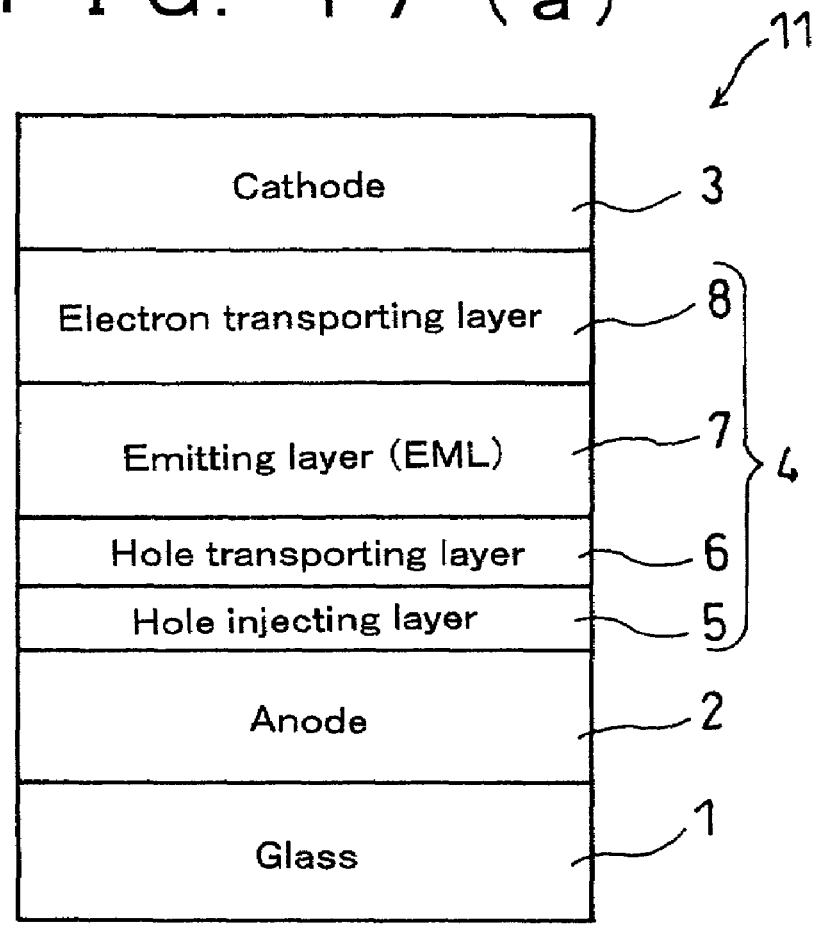
FIG. 17(*a*) is a cross sectional view showing a structure of an organic EL element used in the embodiments of the present invention, in which FIG. 17(*b*) is a structural formula showing an exemplary material of an emitting layer of FIG. 17(*a*).
Figure 17:
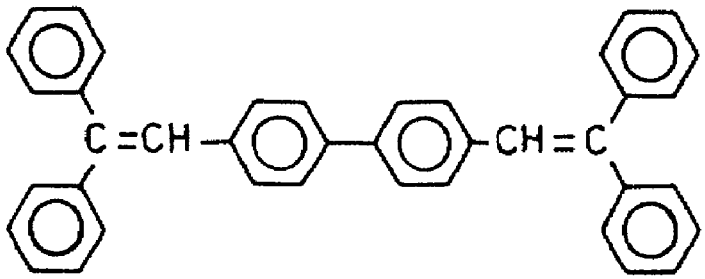

Organic EL (Electro Luminescence) elements used in the embodiments of the present invention has a structure, for example, as shown in FIG. 17(*a*) and FIG. 17(*b*), in which FIG. 17(*a*) is a cross sectional view showing a structure of an organic EL element (diode emitting element) 11 used in the embodiments of the present invention; and FIG. 17(*b*) is a structural formula of an exemplary material of an emitting layer 7 of FIG. 17(*a*).

The organic EL element 11 has a structure wherein a transparent anode (transparent electrode) 2 such as ITO is formed on a glass 1, and an organic multi-layered film 4 is formed thereon. On the organic multi-layered film 4 is formed a cathode 3 made of a material such as MgAg, Ca, AlLi, or Al. Among several structures of the organic multi-layered film 4, the embodiments of the present invention adopt a stacked structure of the anode 2, a hole injecting layer 5 of a material such as CuPc, polyaniline or polythiophene, a hole transporting layer 6 of a material such as TPD or α-NPD, the emitting layer 7, and an electron transporting layer 8 of a material such as oxadiazole or Alq3. The emitting layer 7 is made of a material, for example, such as biphenyl (DPVBi: provided by Idemitsu Kousan Co., Ltd.) which emits blue light and has the structural formula as shown in FIG. 17(*b*). Further, the organic EL element 11 may be combined with a color-conversion filter to be compatible with full-color display by converting the monochromatic light emitted by the organic EL element 11.

Note that, the EL element used in EL panels (EL display panels) according to the embodiments of the present invention is not just limited to the organic EL element 11 as shown in FIG. 17(*a*) and FIG. 17(*b*), and may be other organic EL elements including, for example, an emitting layer 7 which is made of a material such as BAlq2 (provided by Eastman Kodak Co.) containing perylene which emits blue light; an iridium complex such as $Ir(ppy)_3$ which emits green light; Alq3 containing quinacridone; and Alq3 containing DCJTB which emits red light. Further, even though the embodiments of the present invention will be explained based on a structure for monochromatic color display, this structure may be used in combination with other analogous structures to effect full-color display, for example, by displaying colors of R, G, and B (red, green, blue).

The process of forming the organic EL element 11 on an active substrate is similar to that in the foregoing Tokukaihei 10-268798 or 8-234683 as described in the BACKGROUND OF THE INVENTION section, and a further explanation thereof is omitted here.

Figure 18:
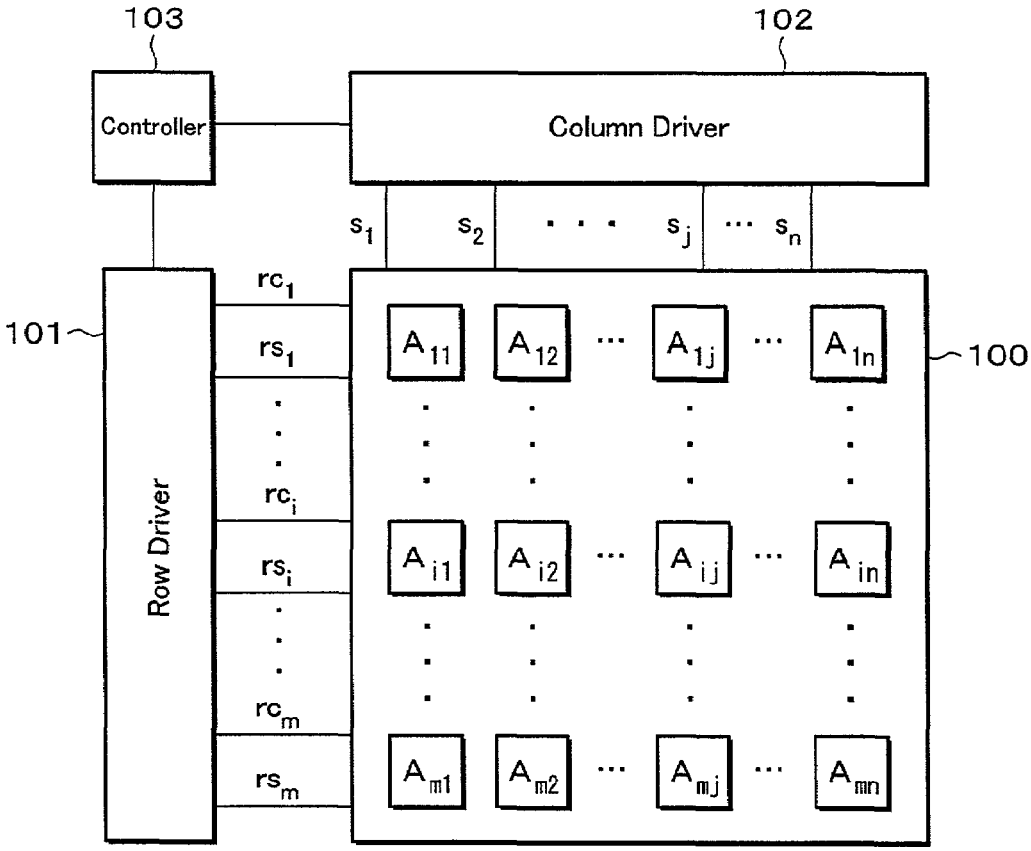
FIG. 18 is a block diagram showing a structure of the EL panel and its driving system according to the embodiments of the present invention.
Figure 19:
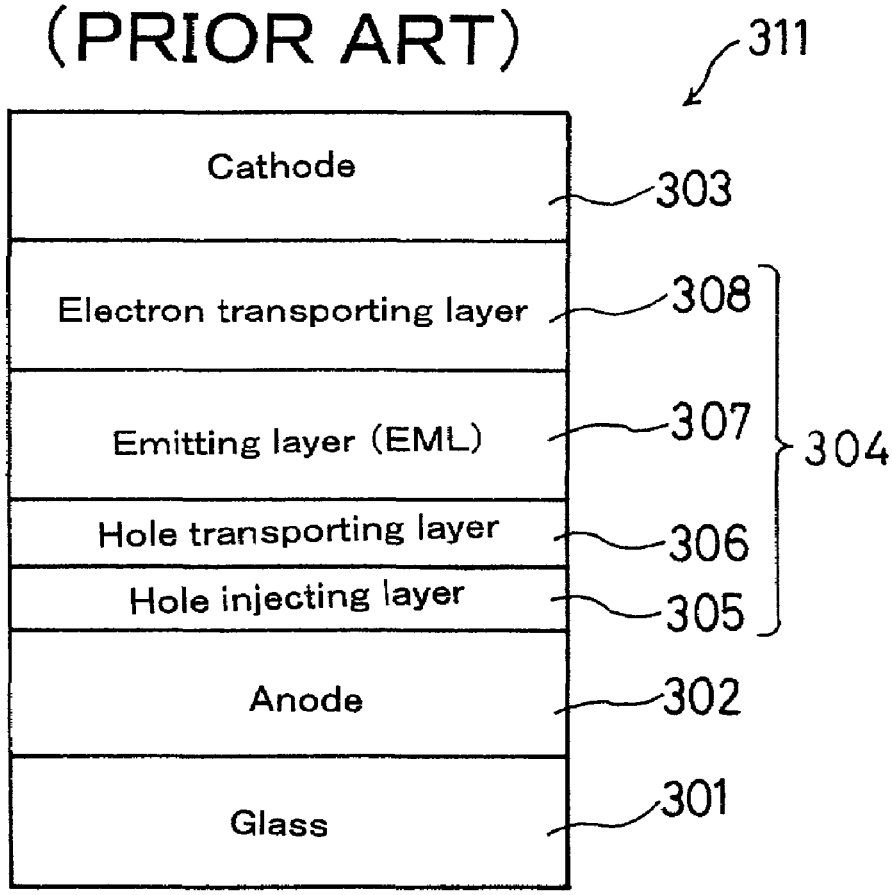
FIG. 19 (a) (PRIOR ART)
FIG. 19(*a*) is a cross sectional view showing a structure of a conventional blue-color emitting organic EL element, and FIG. 19(*b*) is a structural formula of an emitting layer of FIG. 19(*a*).
Figure 19:
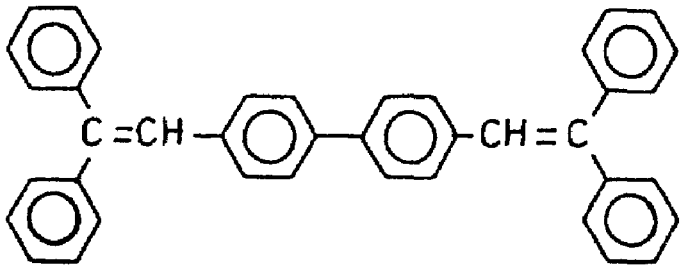
FIG. 19 (b) (PRIOR ART)
Figure 20:
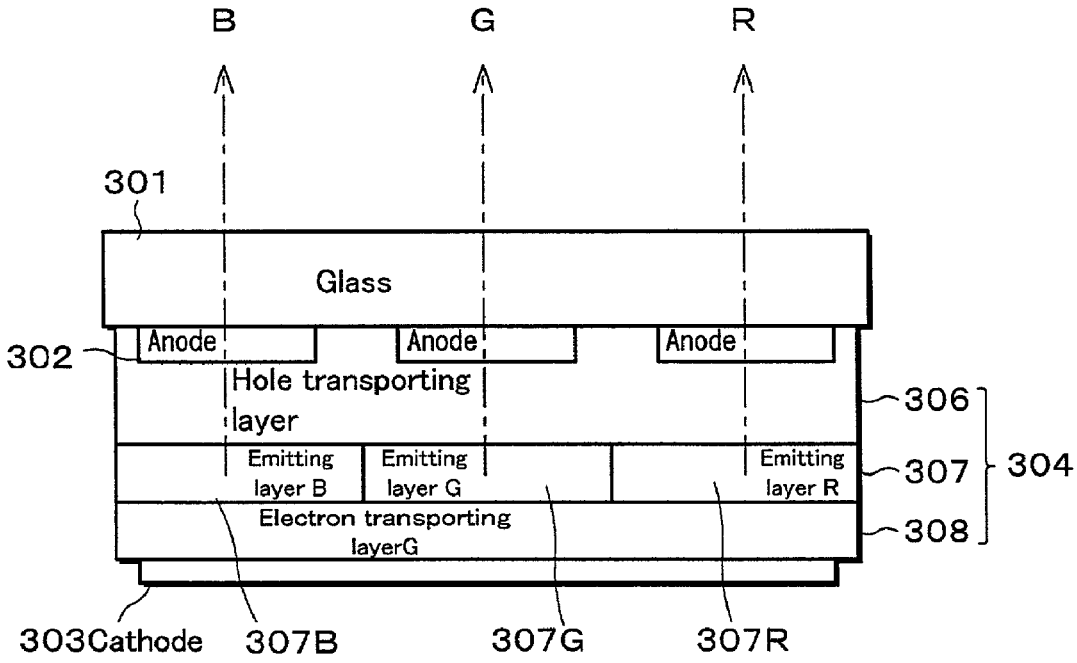
FIG. 20 (PRIOR ART)
FIG. 20 is a cross sectional view showing a pixel structure of a conventional emitting organic EL element of three colors R, G, and B.
Figure 21:
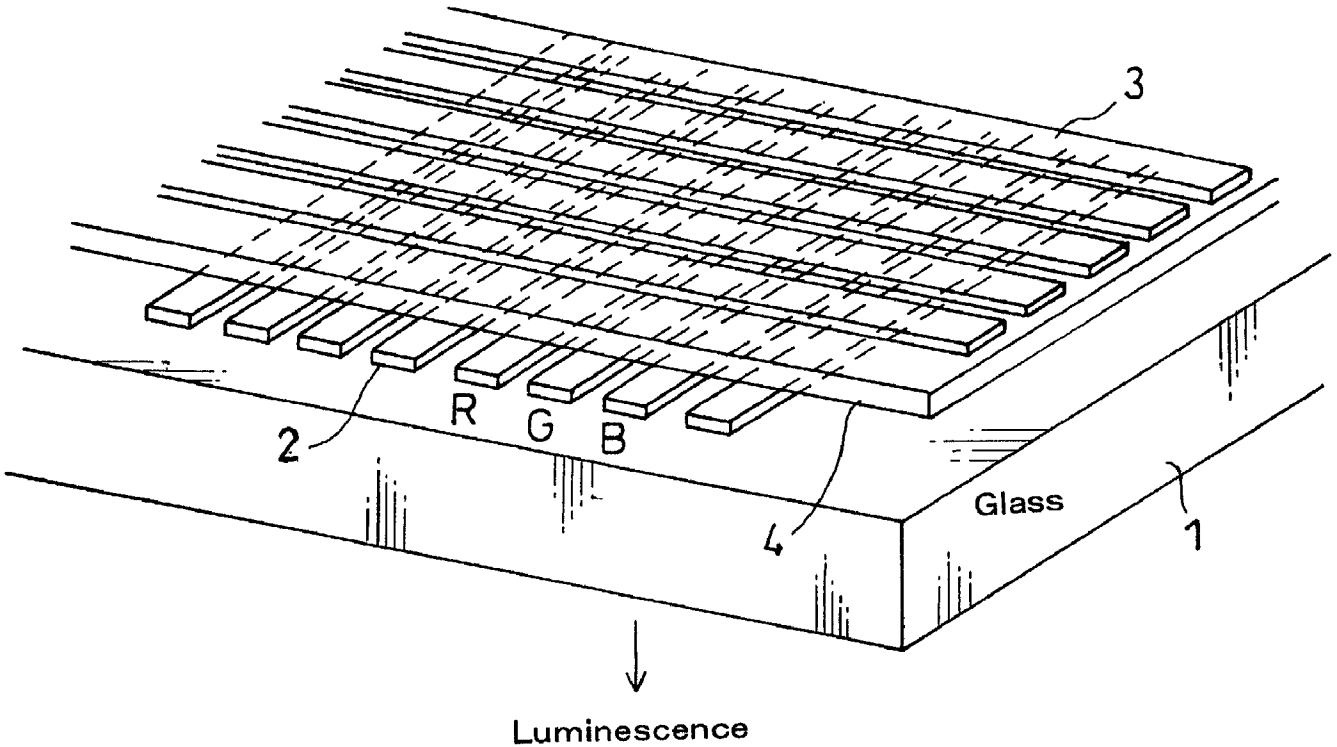
FIG. 21 (PRIOR ART)
FIG. 21 is a perspective view showing a structure of a simple-matrix-type EL panel using organic EL elements.
Figure 22:
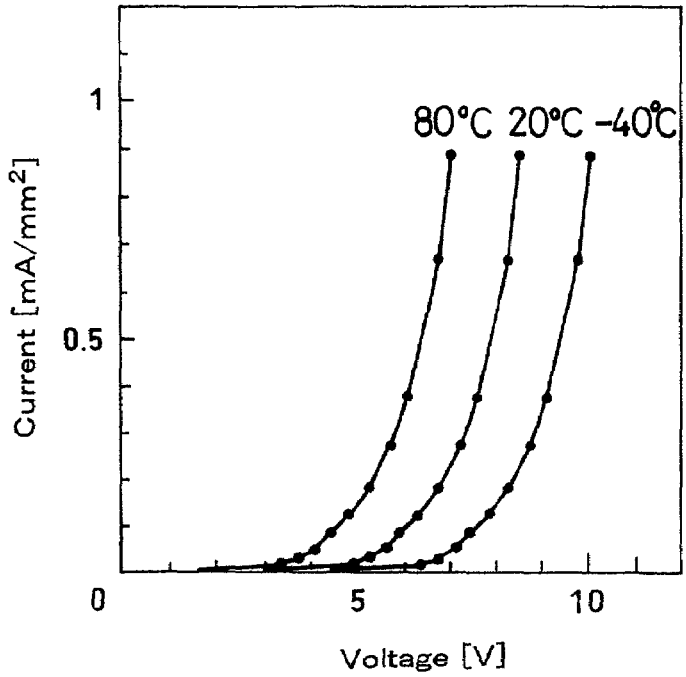
FIG. 22 (PRIOR ART)
FIG. 22 is a graph showing a relation between (i) a voltage between a cathode and anode of the organic EL element as shown in FIG. 19 and FIG. 20 and (ii) a current flowing through the emitting layer.
Figure 23:
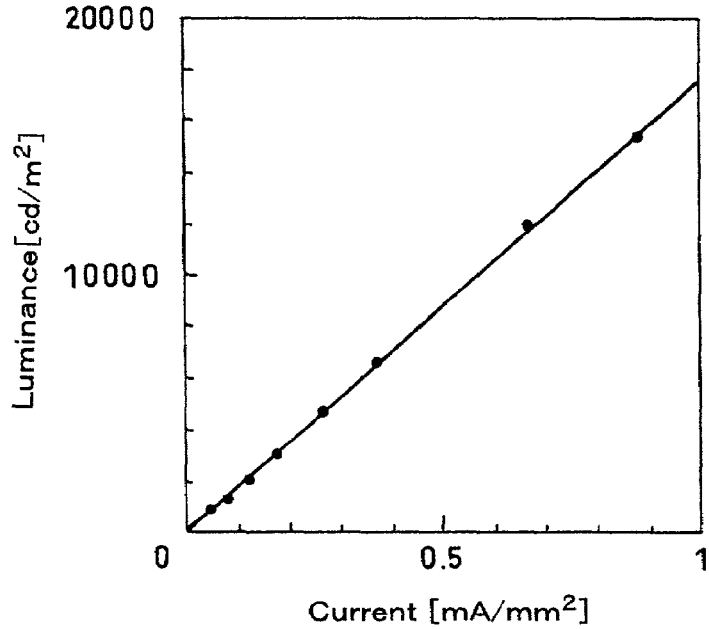
FIG. 23 (PRIOR ART)
FIG. 23 is a graph showing a relation between (i) a current flowing through the emitting layer of the organic EL element as shown in FIG. 19 and FIG. 20 and (ii) luminance.
Figure 24:
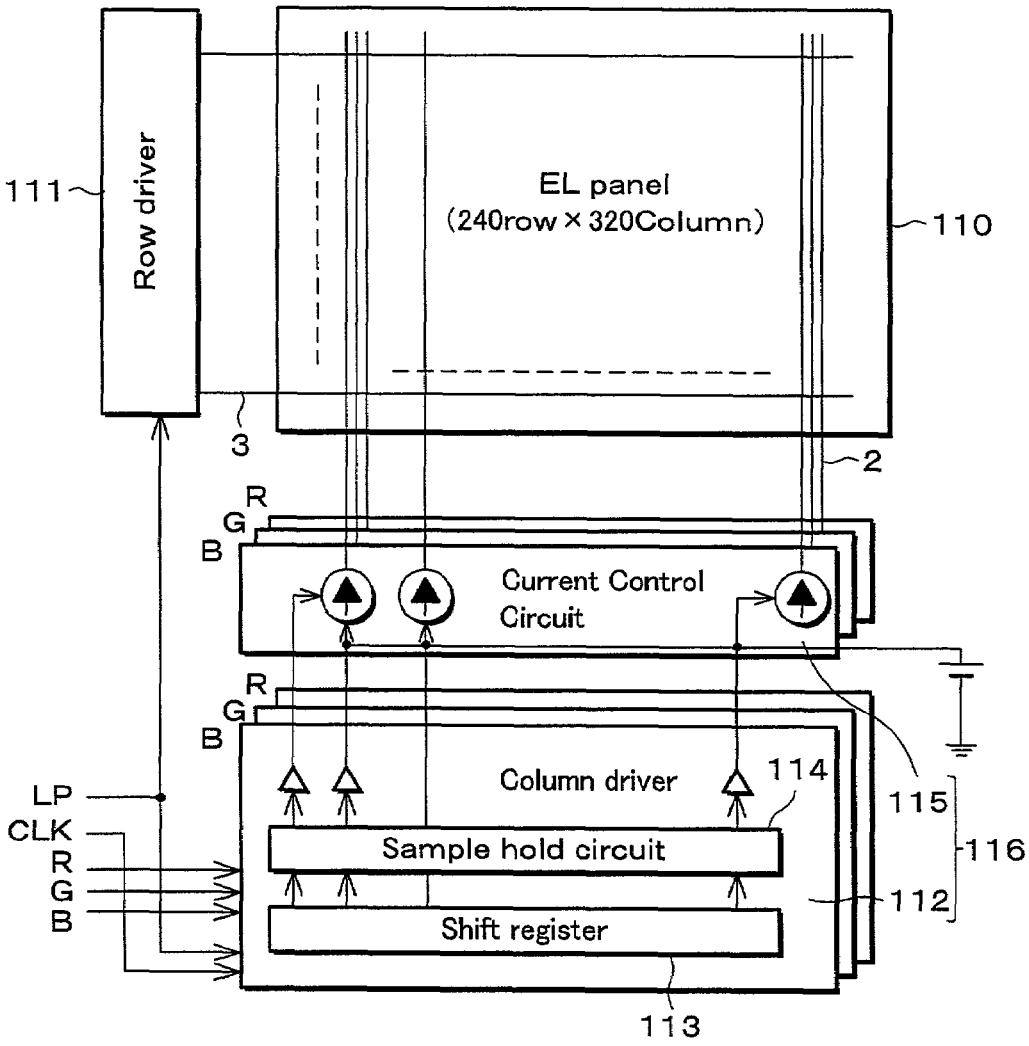
FIG. 24 (PRIOR ART)
FIG. 24 is a block diagram showing a structure of a conventional matrix-type EL panel.
Figure 25:
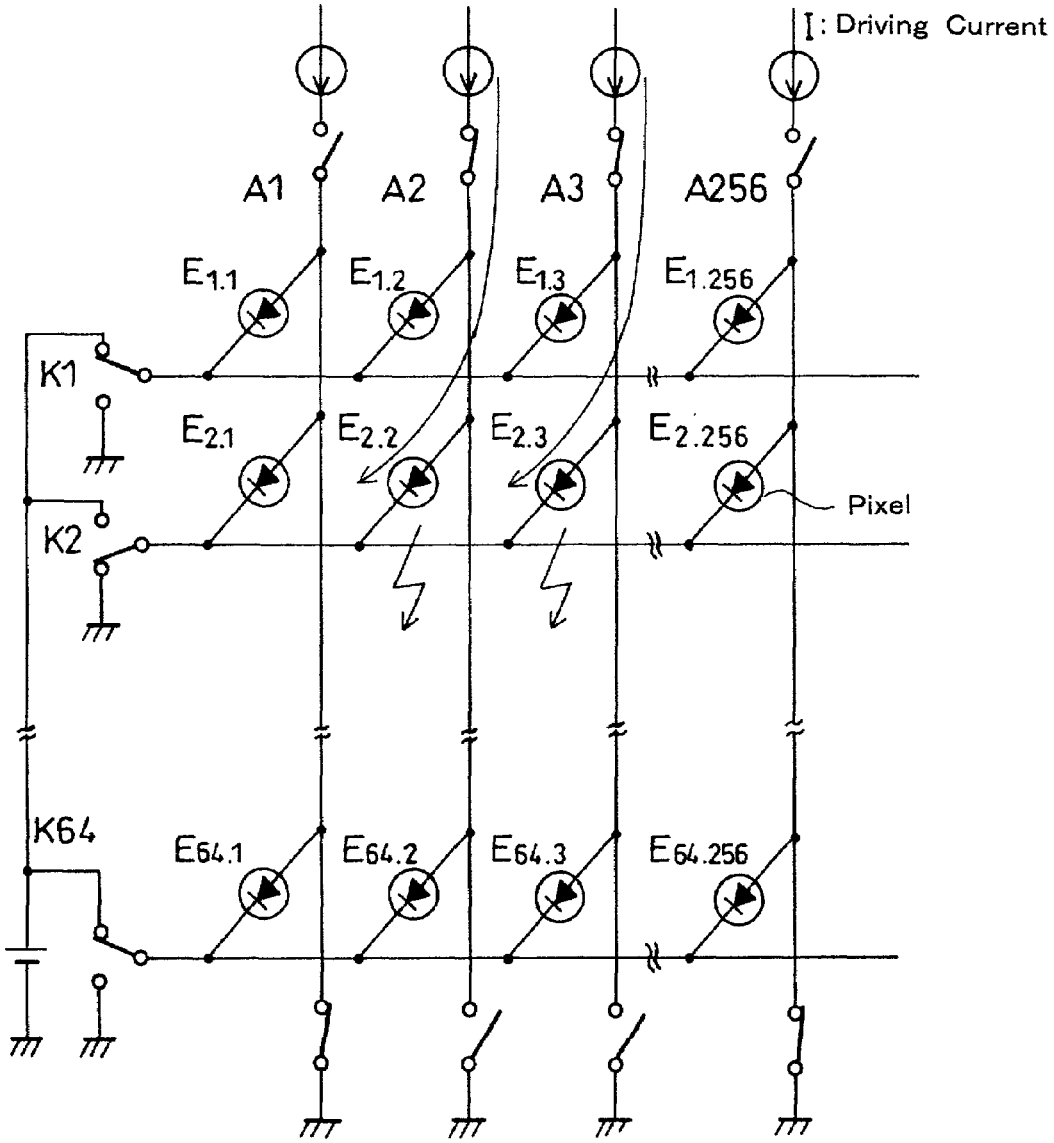
FIG. 25 (PRIOR ART)
FIG. 25 is a circuit diagram showing a driving circuit of a conventional simple-matrix-type EL panel.

FIG. 18 shows an entire structure of an EL panel having the described organic EL element 11 for each pixel. FIG. 18 is a block diagram showing a structure of the EL panel and its driving system according to the embodiments of the present invention.

It is assumed in the following that pixels are disposed in an array pattern (m rows×n columns), and the direction of scanning lines and the direction of signal lines (data lines) of the pixels are row direction and column direction, respectively. The rows are numbered 1, 2, . . . , i, . . . , m, and the columns are numbered 1, 2, . . . , j, . . . , n. Where rows and columns need to be distinguished, elements which belong to an ith row are indicated with the subscript "i" on their reference numerals, and elements which belong to a jth column are indicated with the subscript "j" on their reference numerals. Further, where rows and columns need to be distinguished, pixels and constituting elements therein which belong to an ith row and a jth column are indicated with the subscript "ij" on their reference numerals. Note that, i, j, m, and n are all natural numbers, and satisfy $i \leqq m$, and $j \leqq n$.

An EL panel (display panel) 100 is connected to a row driver 101 and a column 102 for driving the EL panel 100. To the row driver 101 and the column driver 102 is connected a controller 103 for sending image signals to the row driver 101 and the column driver 102 and for controlling these drivers. The row driver 101, the column driver 102, and the controller 103 make up a control section.

The row driver 101 and the EL panel 100 are connected to each other by two scanning connection lines $rc_i$ and $rs_1$, which are provided for each row. The scanning connection lines $rc_i$ and $rs_i$ are connected to scanning electrodes $Rc_i$ and $Rs_i$ (or scanning electrodes $G_i$ and $R_i$), which are to be described later. Further, the column driver 102 and the EL panel 100 are connected to each other by a single signal connection line $s_j$, which is provided for each column. The signal connection line $s^j$ is connected to a signal electrode $s_j$, which is to be described later.

[First Embodiment]

Figure 1:
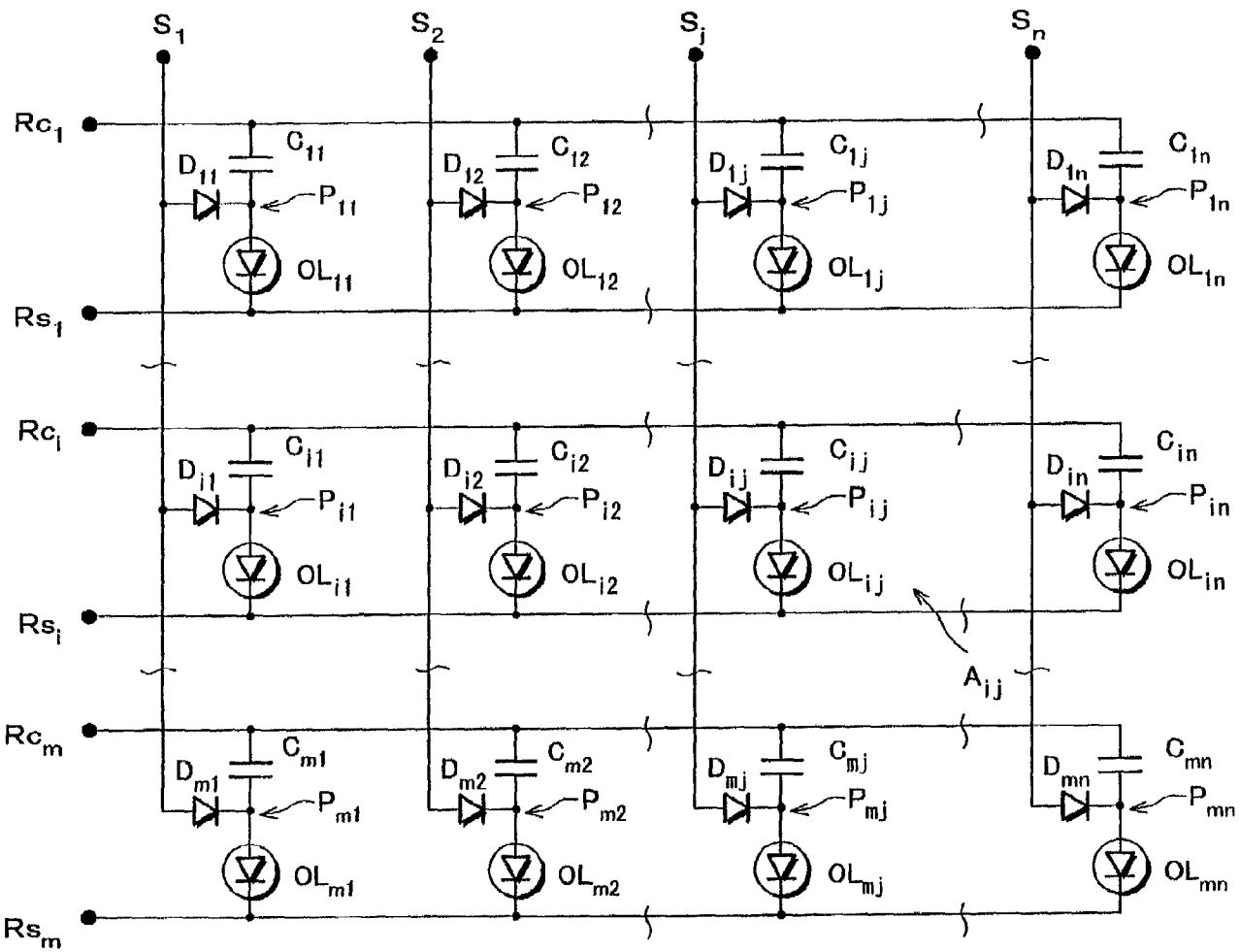
FIG. 1 is a circuit diagram showing an equivalent circuit of pixels in an EL panel according to a First Embodiment of the present invention.

The following describes a structure of an EL panel employing diode active elements, and its driving method, with reference to FIG. 1 through FIG. 4. The EL panel (display panel) of the present embodiment has a structure as shown in FIG. 1. FIG. 1 is a circuit diagram showing an equivalent circuit of pixels of the EL panel of the present embodiment.

In the EL panel of the present embodiment, each row has a scanning electrode (second scanning electrode) Rc and a scanning electrode (first scanning electrode) Rs. The scanning electrodes Rc and Rs are connected to each pixel A of each row. Further, in the EL panel of the present embodiment, each column has a signal electrode S. The signal electrode S is connected to each pixel A of each column. That is, the EL panel of the present embodiment includes 2 m electrodes on the scanning side and n electrodes on the signal side (data side).

A pixel (emitter) $A_{ij}$ of the EL panel includes a diode element (active element, diode active element) $D_{ij}$, an organic EL element (diode emitting element) $OL_{ij}$, and a capacitor $C_{ij}$. The cathode (first terminal) of the diode element $D_{ij}$, the anode (first terminal) of the organic EL element $OL_{ij}$, and one of the electrodes (first terminal) of the capacitor $C_{ij}$ are electrically connected to one another at a common terminal $P_{ij}$. Further, the anode (second terminal) of the diode element $D_{ij}$, i.e., the terminal on the other side of the common terminal $P_{ij}$, is connected to the signal electrode $S_j$. The other electrode (second terminal) of the capacitor $C_{ij}$, i.e., the terminal on the other side of the common terminal $P_{ij}$, is connected to the scanning electrode $Rc_1$. The cathode (second terminal) of the organic EL element $OL_{ij}$, i.e., the terminal on the other side of the common terminal $P_{ij}$, is connected to the scanning electrode $Rs_i$. As a result, the forward direction of the diode element $D_{ij}$ and the forward direction of the organic EL element $OL_{ij}$ coincides.

Figure 2:
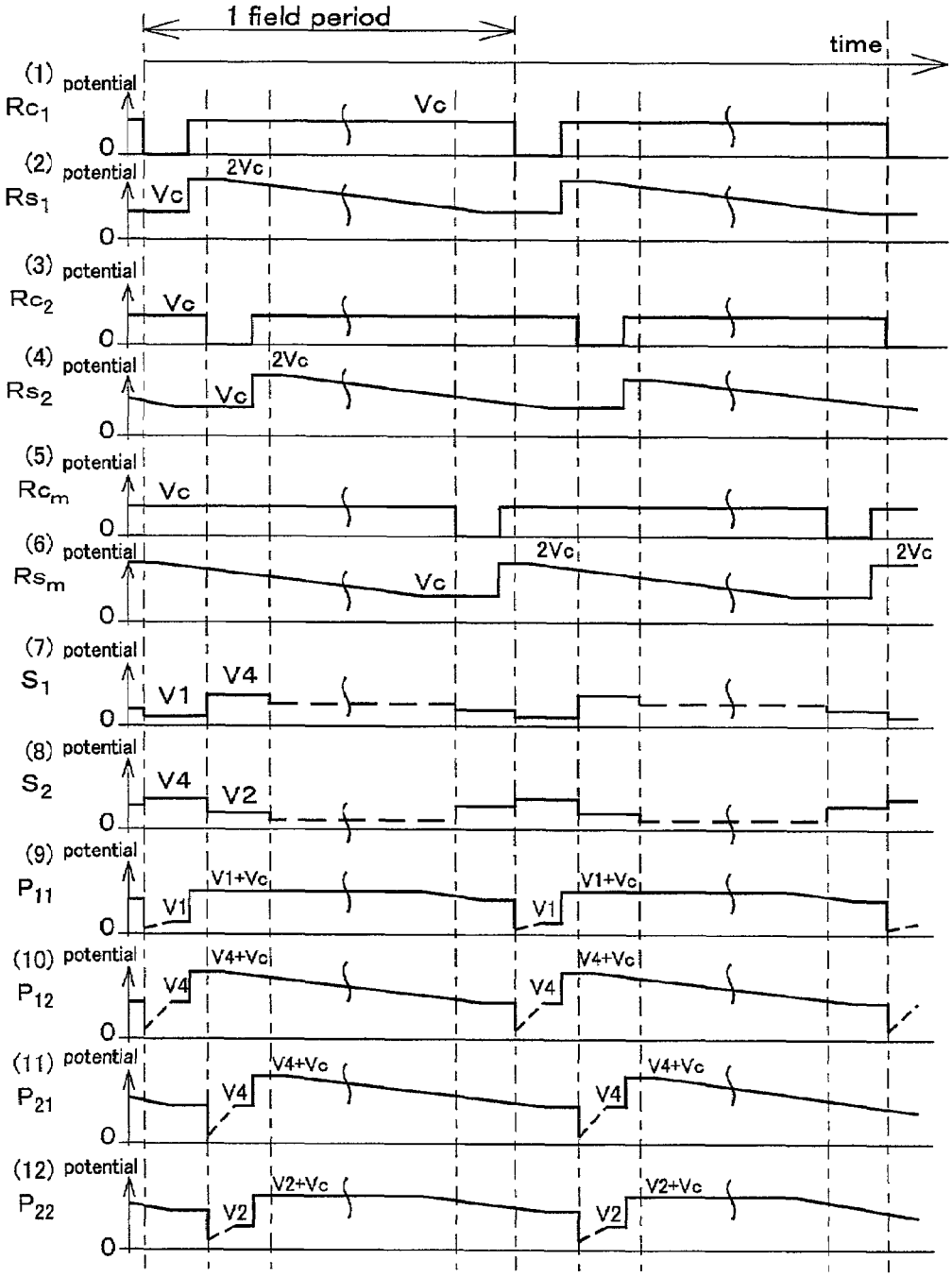
FIG. 2 is a timing chart showing changes in potentials of electrodes when driving the EL panel according to the First Embodiment of the present invention.
Figure 3:
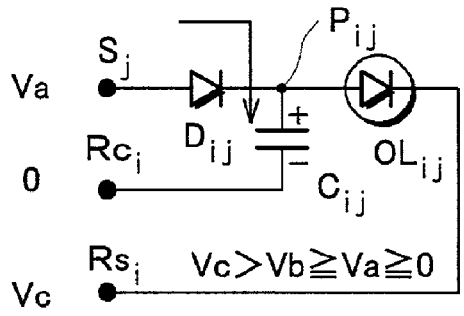
FIG. 3(*a*) through FIG. 3(*c*) are schematic drawings showing states of a pixel when driving the EL panel according to the First Embodiment of the present invention, in which FIG. 3(*a*) shows a selected state.
Figure 3:
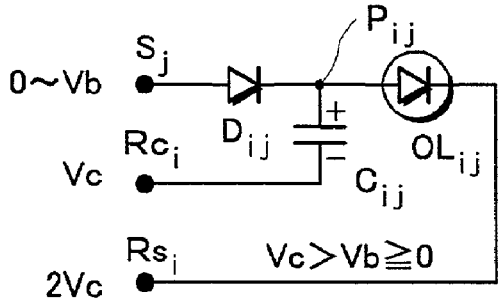
Figure 3:
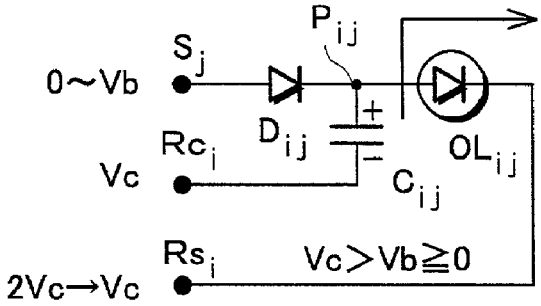

The following describes the driving method of the EL panel with reference to FIG. 2 and FIG. 3(*a*) through FIG. 3(*c*). FIG. 2 is a timing chart showing changes in potentials of respective electrodes when driving the EL panel of the present embodiment. FIG. 3(*a*) through FIG. 3(*c*) are schematic drawings showing different states of the pixel $A_{ij}$ when driving the EL panel, in which FIG. 3(*a*) shows a selected state; FIG. 3(*b*) shows a non-selected state 1; and FIG. 3(*c*) shows a non-selected state 2. Indicated by (1) and (2), (3) and (4), and (5) and (6) in FIG. 2 is changes in potentials which are set for the scanning electrodes $Rc_1$ and $Rs_1$, scanning electrodes $Rc_2$ and $Rs_2$, and scanning electrodes $Rc_m$ and $Rs_m$, respectively. Further, indicated by (7) and (8) in FIG. 2 is changes in potentials which are set for signal electrodes $S_1$ and $S_2$, respectively. Further, indicated in (9), (10), (11), and (12) in FIG. 2 is changes in potentials at common terminals $P_{11}$, $P_{12}$, $P_{21}$, and $P_{22}$.

In order to drive the EL panel, the rows are selected successively from the first row to the mth row, so as to charge capacitors C of pixels A in each row. The pixels A, which became non-selected after the capacitors C are charged, allow the organic EL elements OL to emit light while the stored charge in the capacitors C is discharged. Note that, the period from the selection of the first row to the selection of the mth row makes up one field period.

The following explains driving of the EL panel in more detail. When the first row is selected, the potential of the scanning electrode Rc is brought to 0, and the potential of the scanning electrode $Rs_1$ is brought to Vc (Vc>0) ((1) and (2) in FIG. 2), while setting signal potentials for the respective signal electrodes $S_j$. The signal potentials are in accordance with tones to be displayed by the pixel $A_{1j}$ of the first row. Here, a pixel $A_{11}$ and a pixel $A_{12}$ are set to V1 (V1>0) and V4 (V4>0), respectively ((7) and (8) in FIG. 2). Here, the potentials of the respective common terminals $P_{11}$ and $P_{12}$ of the pixels $A_{11}$ and $A_{12}$ gradually increase, from the potentials before the selection, to reach the signal potentials V1 and V4, respectively ((9) and (10) in FIG. 2). Note that, a common signal potential will be indicated by Va. Also, Vc is larger than maximum value Vb of the signal potential Va ($Vc>Vb \geqq Va \geqq 0$).

The state (selected state) where the pixel $A_{ij}$ is selected is as shown in FIG. 3 (*a*). In the selected state, the potentials of the scanning electrode $Rc_1$ and the signal electrode $S_j$ are set to 0 and Va, respectively. This applies a potential difference of a forward potential state (conduction state) to the diode element $D_{ij}$, with the result that a current is flown through the diode element $D_{ij}$. Further, a charge according to the signal potential Va is stored in the capacitor $C_{ij}$. Here, a positive charge is injected into the electrode of the capacitor $C_{ij}$ on the side of the common terminal $P_{ij}$. In this case, since Vc is larger than maximum value Vb of the signal potential Va, a potential difference of a reverse potential state (non-conduction state) is applied to the organic EL element $OL_{ij}$. Thus, no current is flown through the organic EL element $OL_{ij}$, and no light is emitted therefrom.

Then, before shifting to the second row, the potentials of the scanning electrode $Rc_i$ and the potential of the scanning electrode $Rs_i$ are set to Vc and 2Vc, respectively (FIG. 3(*b*), non-selected state 1). The potential Vc of the scanning electrode $Rc_i$ is larger than Vb, which is the maximum value of the signal electrode $S_j$, and there is a potential difference Va in the capacitor $C_{ij}$, and therefore, in the non-selected state 1, a potential difference of a reverse potential state (non-conduction state) is applied to the diode element $D_{ij}$. Accordingly, there is no flow of charge in and out of the capacitor $C_{ij}$ through the diode element $D_{ij}$. Further, the common terminal $P_{ij}$ comes to have a potential (Va+Vc) as a result. Even in this state, the potential 2Vc of the scanning electrode $Rs_i$ is larger than the potential (Va+Vc) of the common terminal $P_{ij}$, and thus a potential difference of a reverse potential state (non-conduction state) is applied to the organic EL element $OL_{ij}$. As a result, there is no current flow through the organic EL element $OL_{ij}$, and no light is emitted therefrom.

Then, a transition occurs from the non-selected period 1 to the non-selected period 2. The non-selected state may have any duration above 0. Afterward, the potential of the scanning electrode $Rs_i$ is gradually decreased from 2Vc to Vc, before the pixel $A_{ij}$ takes the next selected state (FIG. 3(*c*), non-selected state 2). Here, the potential of the scanning electrode $Rc_i$ is maintained at Vc. As a result, at the time when the potential of the scanning electrode $Rs_i$ becomes smaller than the potential (Va+Vc) of the common terminal $P_{ij}$, a potential difference of a forward potential state (conduction state) is applied to the organic EL element $OL_{ij}$.

Figure 31:
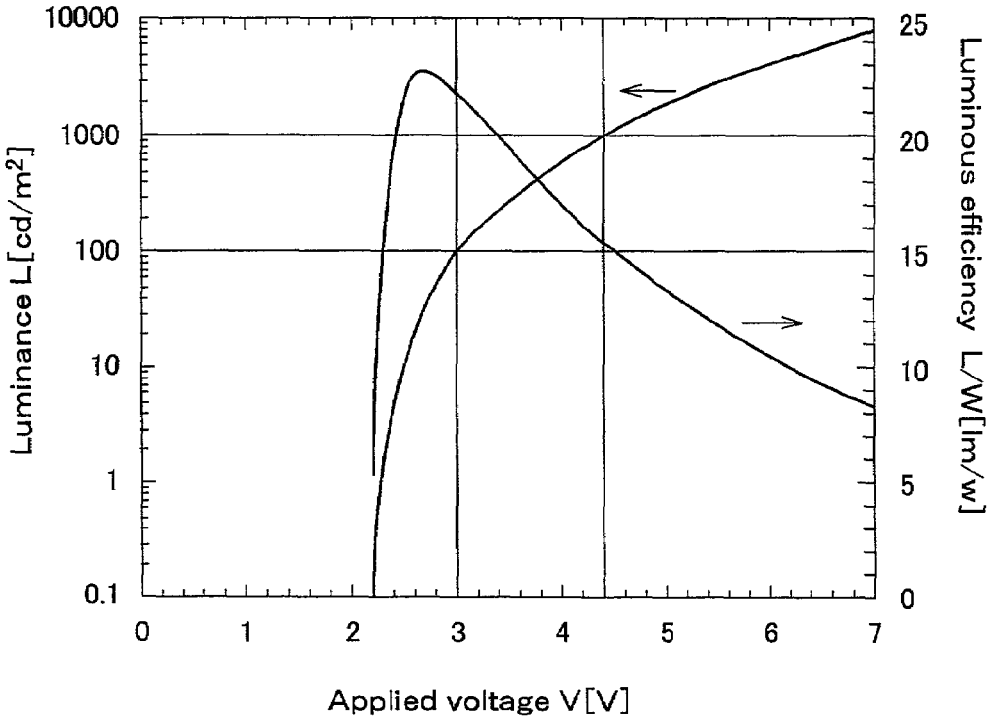
FIG. 31 is a graph showing a relation between an applied voltage of an organic EL element, and luminance or luminous efficiency.
Figure 32:
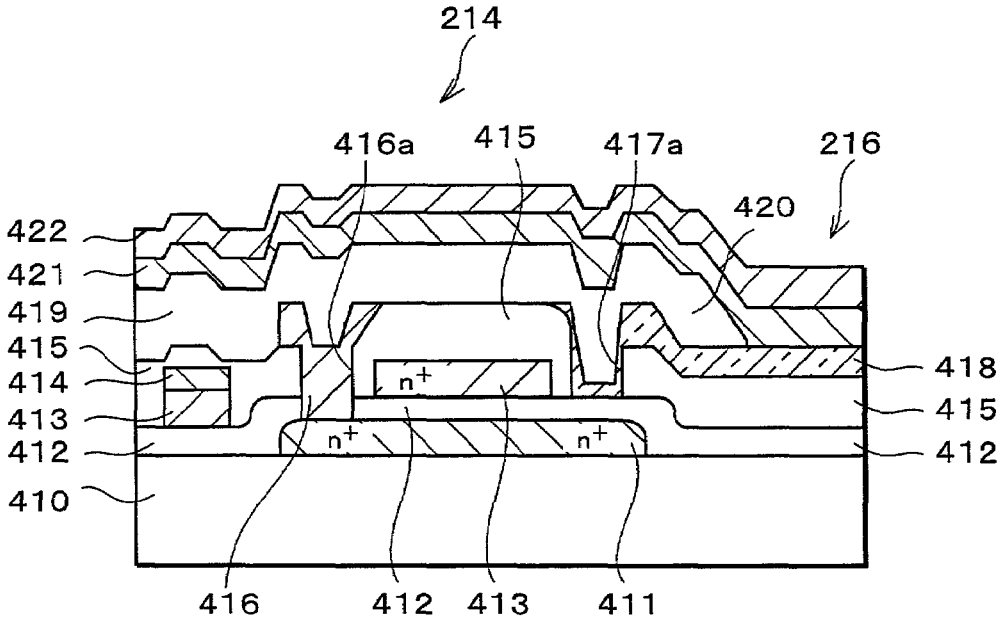
FIG. 32 (PRIOR ART)
FIG. 32 is a cross sectional view, taken along the line B—B of FIG. 30.
Figure 33:
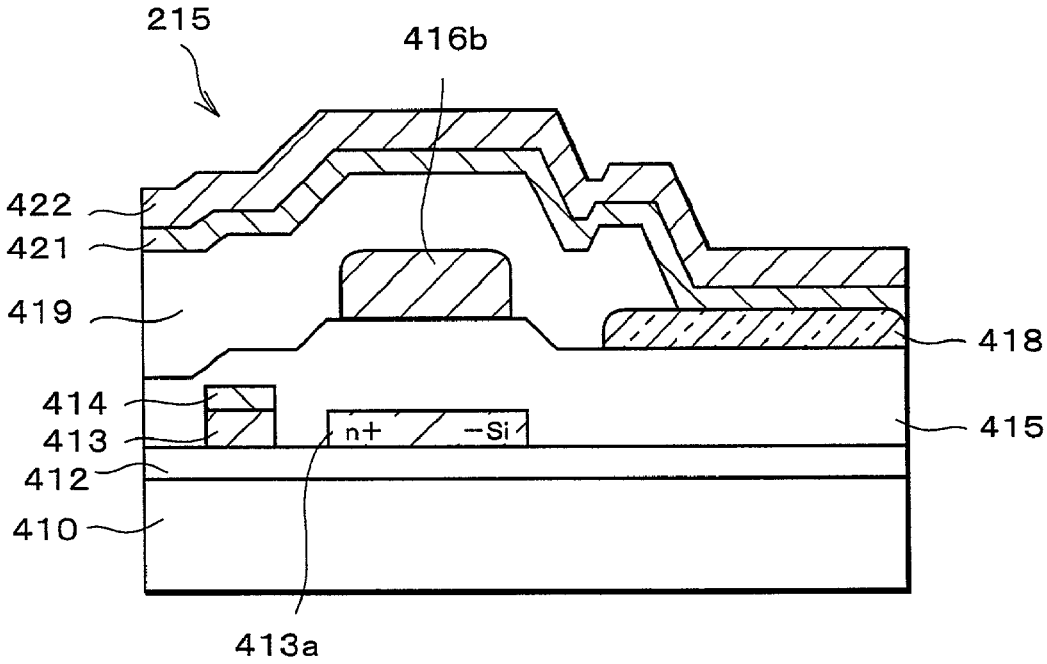
FIG. 33 (PRIOR ART)
FIG. 33 is a cross sectional view, taken along the line C—C of FIG. 30.

Here, if the capacitor $C_{ij}$ is storing charge which would generate a potential difference at or above the forward ON potential of the organic EL element $OL_{ij}$, the charge will be released via the organic EL element $OL_{ij}$, starting from the time when the potential of the scanning electrode $Rs_i$ becomes smaller than the potential (Va+Vc) of the common terminal $P_{ij}$, until the potential of the scanning electrode $Rs_i$ becomes Vc. While this is occurring, the organic EL element $OL_{ij}$ emits light. That is, in the non-selected state 2, the organic EL element $OL_{ij}$ emits light by the current flow through the organic EL element $OL_{ij}$ according to the stored charge in the capacitor $C_{ij}$ (current according to the signal potential). This luminescence by the organic EL element $OL_{ij}$ in the non-selected state 2 allows tone expression according to the signal potential. Note that, in the applied voltage-luminance characteristics of the organic EL element $OL_{ij}$ as shown in FIG. 31, which was described in the foregoing BACKGROUND OF THE INVENTION section, the forward ON potential of the organic EL element $OL_{ij}$ is presumably about 2.2 V.

The current through the organic EL element $OL_{ij}$ is based on a potential difference between the cathode and anode of the organic EL element $OL_{ij}$. The potential difference Vf generated between the cathode and anode of the organic EL element $OL_{ij}$ is $$Vf = Vrc + Qf/Cf - Vrs,$$

where Vrc is the potential of the scanning electrode $Rc_i$, Qf is the charge stored in the capacitor $C_{ij}$, Cf is the capacitance of the capacitor $C_{ij}$, and Vrs is the potential of the scanning electrode $Rs_i$. Here, current If flowing between the cathode and anode of the organic EL element $OL_{ij}$ is the change in quantity of the stored charge in the capacitor $C_{ij}$. Thus, by differentiating the foregoing equation with respect to time, the potential of the scanning electrode $Rc_i$, which is a constant, will be cancelled, so that $$d(Vf)/dt=d(Qf/Cf)/dt-d(Vrs)/dt, \text{ and therefore } Cf\times d(Vf)/dt=d(Qf)/dt-Cf\times d(Vrs)/dt=If-Cf\times d(Vrs)/dt.$$

Here, when the potential difference Vf generated between the cathode and anode of the organic EL element $OL_{ij}$ is practically fixed, d(Vd)/dt will be almost 0, and thus the current If flowing between the cathode and anode of the organic EL element $OL_{ij}$ becomes $$If=Cf\times d(Vrs)/dt.$$

That is, the current flow through the organic EL element $OL_{ij}$ can be controlled by controlling the rate of change of the potential of the scanning electrode $Rs_i$ from 2Vc to Vc, i.e., by controlling the gradient of the potential change of the scanning electrode $Rs_i$.

Thus, the gradient of the potential change of the scanning electrode $Rs_i$ is set so that the current through the organic EL element $OL_{ij}$ takes a current value which causes the organic EL element $OL_{ij}$ to emit light with high luminous efficiency. This makes it possible to always drive the organic EL element $OL_{ij}$ with high luminous efficiency, thereby improving luminous efficiency of the EL panel.

The second row is selected after the selected state of the pixel $A_{ij}$ of the first row, or after the following non-selected state 1. Selecting the second row, the potential of the scanning electrode $Rc_2$ and the potential of the scanning electrode $Rs_2$ are set to 0 and Vc (Vc>0), respectively ((3) and (4) in FIG. 2), while setting signal potentials for the respective signal electrodes $S_j$. Here, a pixel $A_{21}$ and a pixel $A_{22}$ are set to V4 and V2 (V2>0), respectively ((11) and (12) in FIG. 2). Then, in the same manner as above, a pixel $A_{22}$ is set to the non-selected state 1 and the non-selected state 2, so as to drive the pixel $A_{2j}$ of the second row.

In the structure of the EL panel of the present embodiment, a near constant current is flown through the organic EL element $OL_{ij}$ to allow luminescence with high luminous efficiency, and light is emitted in tones according to the tone levels (stored charged in capacitor $C_{ij}$) by the duration of emission within one field period. This tone luminescence is realized by a change in potential of the scanning electrode $Rs_i$.

Figure 26:
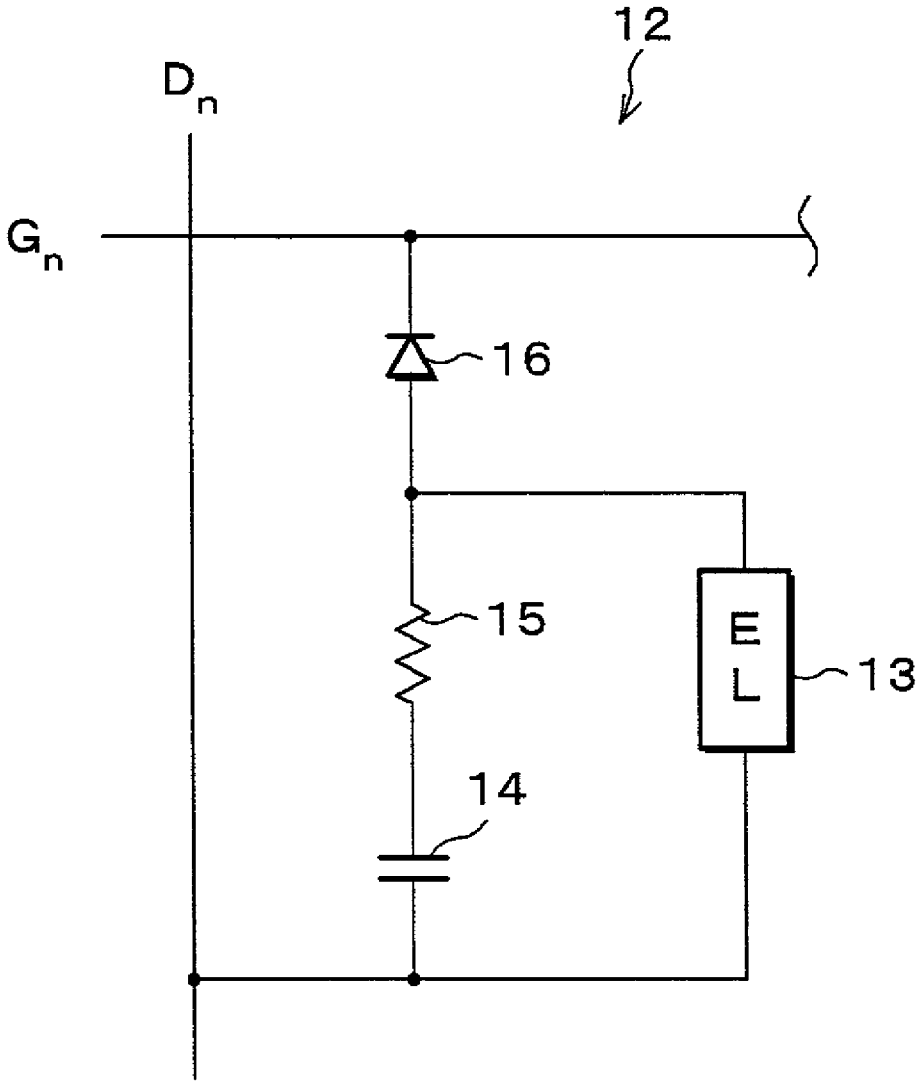
FIG. 26 (PRIOR ART)
FIG. 26 is a circuit diagram showing an equivalent circuit of a pixel of a conventional active-matrix-type EL panel using diodes.
Figure 27:
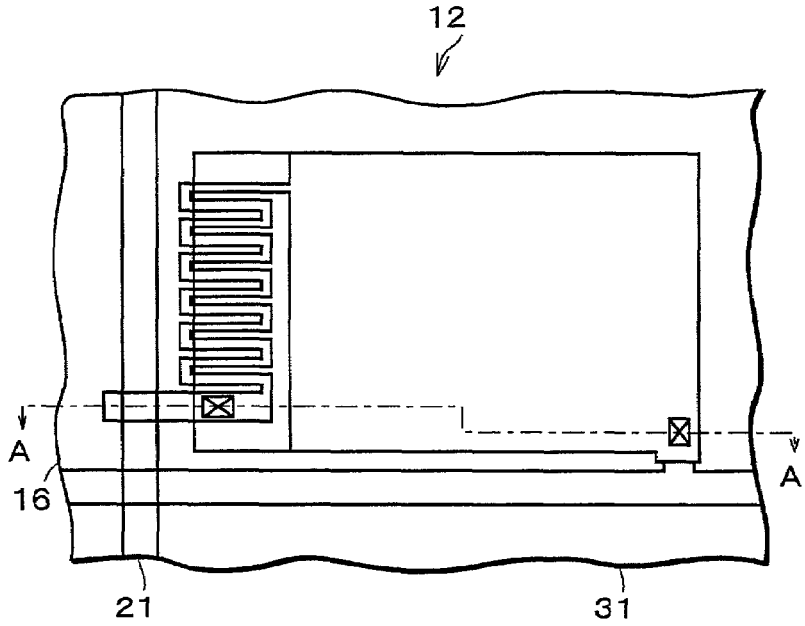
FIG. 27 (a) (PRIOR ART)
FIG. 27(*a*) is a plan view showing a structure of the pixel of FIG. 26, and FIG. 27(*b*) is a cross sectional view, taken along the line A—A of FIG. 27(*a*).
Figure 27:
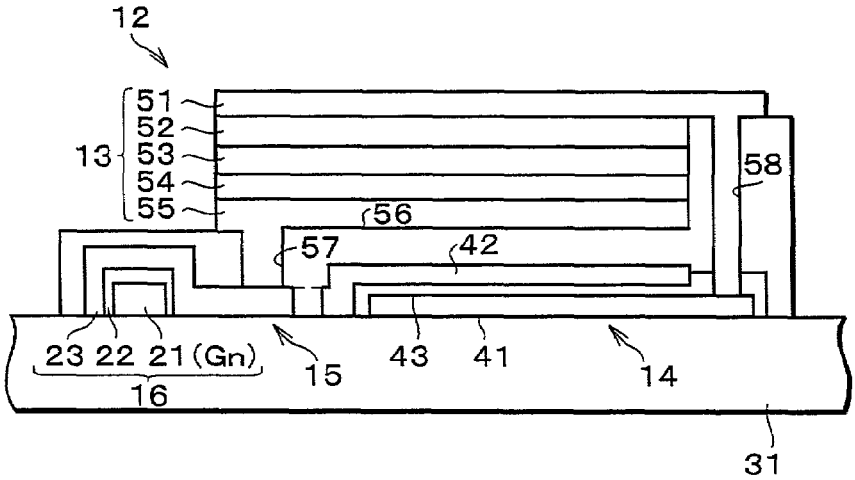
FIG. 27 (b) (PRIOR ART)
Figure 28:
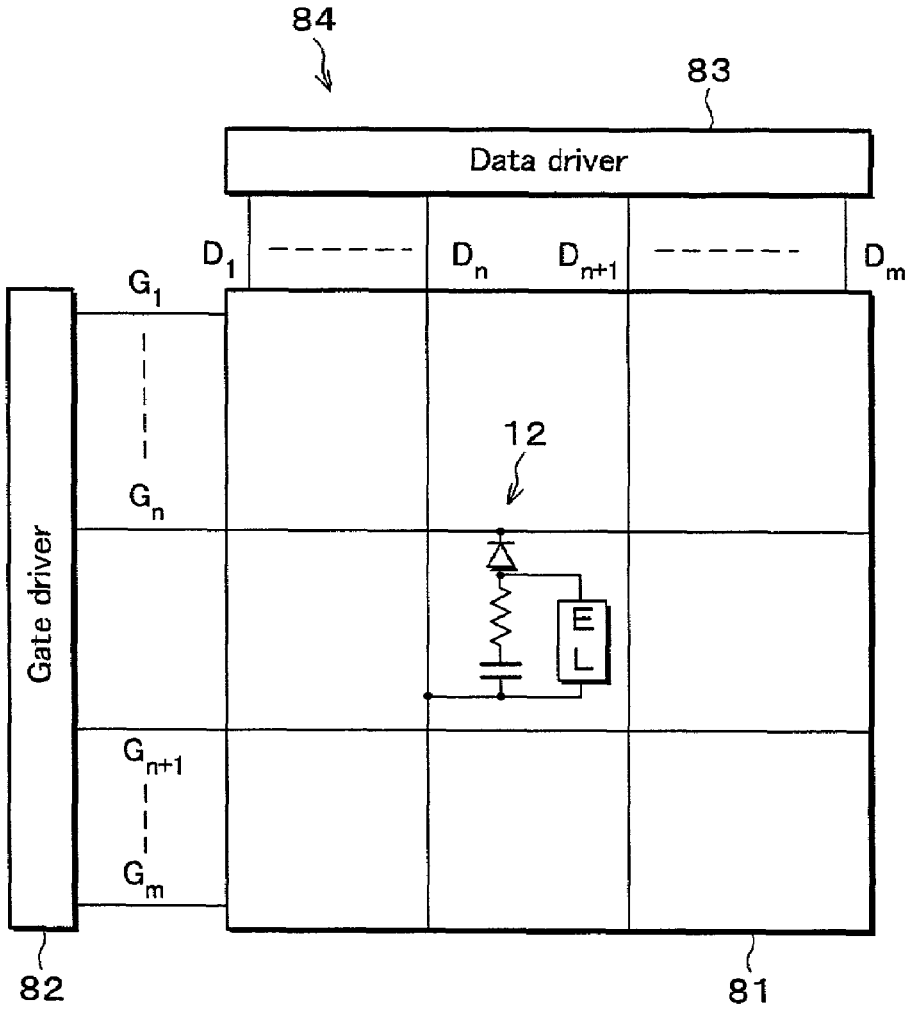
FIG. 28 (PRIOR ART)
FIG. 28 is a block diagram showing a structure of a conventional active-matrix-type EL panel using diodes.

Thus, unlike the pixel structure (as shown in FIG. 26) of the EL panel using diodes as described in the foregoing BACKGROUND OF THE INVENTION section, it is not required to provide an additional resistance for adjusting the time constant of luminescence between diode element $D_{ij}$ and capacitor $C_{ij}$. This solves the problem of generated heat by the current flow through the additional resistance, the problem of low luminous efficiency, and the problem of prolonged charging time for charging the additional capacitance, which is induced by the provision of the additional resistance.

Figure 4:
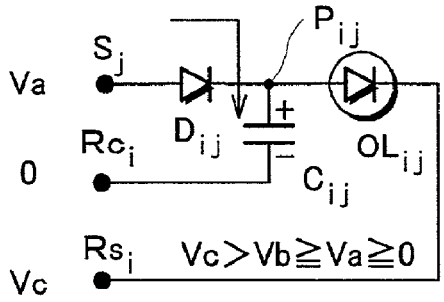
FIG. 4(*a*) through FIG. 4(*c*) are modification examples according to the First Embodiment of the present invention, corresponding to FIG. 3(*a*) through FIG. 3(*c*), respectively.
Figure 4:
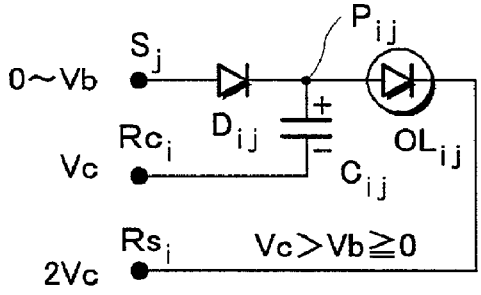
Figure 4:
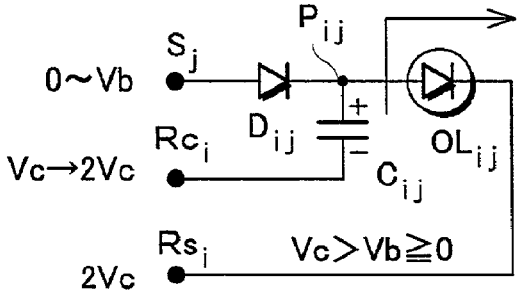

Note that, the foregoing described the case where the potential of the scanning electrode $Rc_i$ is Vc and the potential of the scanning electrode $Rs_i$ is 2Vc in the non-selected state 1 (FIG. 3(*b*)), and the potential of the scanning electrode $Rs_i$ is varied from 2Vc to Vc in the non-selected state 2 (FIG. 3(*c*)). However, not limiting to these, as shown in FIG. 4(*a*) through FIG. 4(*c*), the potential of the scanning electrode $Rc_i$ may be Vc in the non-selected state 1, and the potential of the scanning electrode $Rc_i$ may be varied from Vc to 2Vc in the non-selected state 2. FIG. 4(*a*) through FIG. 4(*c*) are modification examples of FIG. 3(*a*) through FIG. 3(*c*).

Further, in order to reproduce tones more accurately, it is preferable that the quantity of charge stored in the capacitor $C_{ij}$ be more accurately set based on tone levels. To this end, it is preferable that the current through the signal electrode $S_j$ be monitored in the selected period, so as to control the potential of the signal electrode $S_j$ based on the monitored current.

[Second Embodiment]

Figure 5:
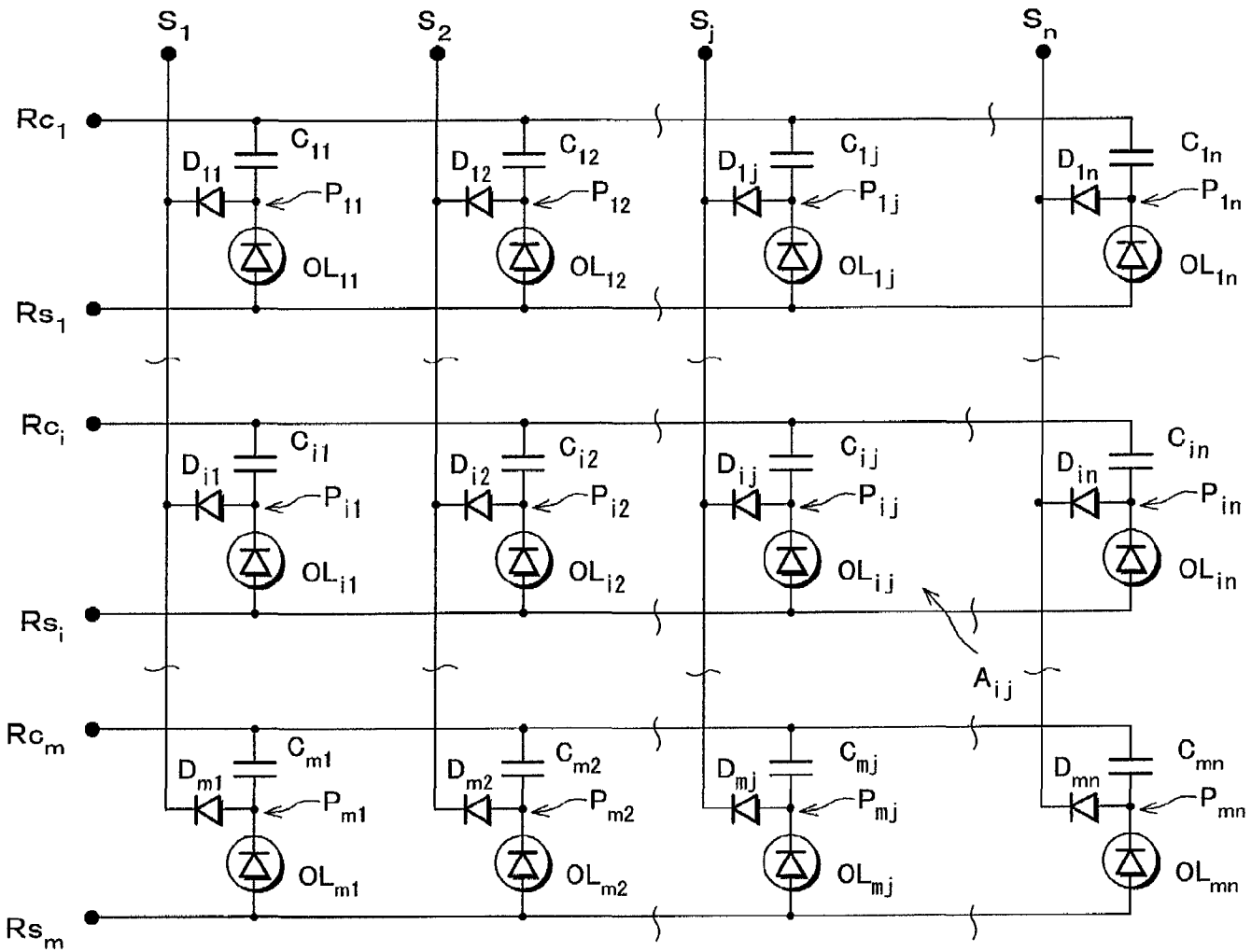
FIG. 5 is a circuit diagram showing an equivalent circuit of pixels in an EL panel according to a Second Embodiment of the present invention.

The present embodiment describes a structure and a driving method thereof, when the polarities of the diode element and the organic EL element are changed with respect to the First Embodiment, with reference to FIG. 5 through FIG. 8. An EL panel (display panel) of the present embodiment has a structure as shown in FIG. 5. FIG. 5 is a circuit diagram showing an equivalent circuit of pixels of the EL panel of the present embodiment.

The EL panel of the present embodiment has the same structure as that of the EL panel of the First Embodiment, except that the polarities of the diode element $D_{ij}$ and the organic EL element $OL_{ij}$ are reversed with respect to the EL panel of the First Embodiment.

That is, in a pixel (emitter) $A_{ij}$ of the EL panel of the present embodiment, the anode of the diode element (active element, diode active element) $D_{ij}$, the cathode (first terminal) of the organic EL element (diode emitting element) $OL_{ij}$, and one of the electrodes (first terminal) of the capacitor $C_{ij}$ are electrically connected to one another at the common terminal $P_{ij}$. Further, the cathode (second terminal) of the diode element $D_{ij}$, i.e., the terminal on the other side of the common terminal $P_{ij}$, is connected to signal electrode $S_j$. The other electrode (second terminal) of the capacitor $C_{ij}$, i.e., the electrode on the other side of the common terminal $P_{ij}$, is connected to scanning electrode $Rc_i$ (second scanning electrode). The anode (second terminal) of the organic EL element $OL_{ij}$, i.e., the terminal on the other side of the common terminal $P_{ij}$, is connected to the scanning electrode $Rs_i$ (first scanning electrode).

Figure 6:
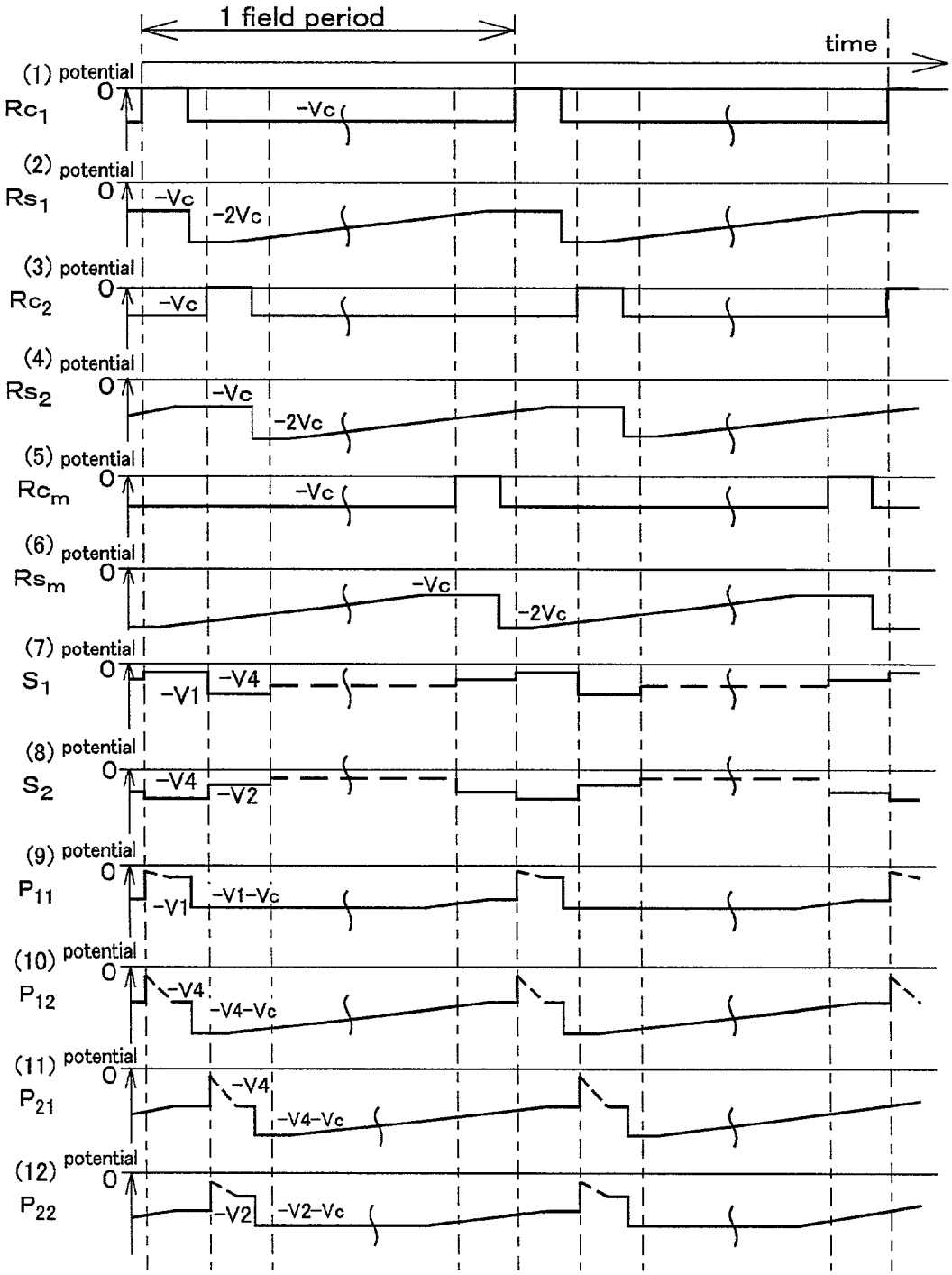
FIG. 6 is a timing chart showing changes in potentials of electrodes when driving the EL panel according to the Second Embodiment of the present invention.
Figure 7:
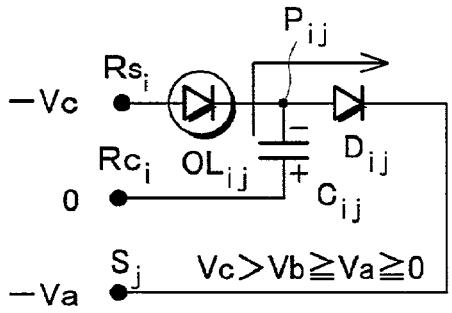
FIG. 7(*a*) through FIG. 7(*c*) are schematic drawings showing states of a pixel when driving the EL panel according to the Second Embodiment of the present invention, in which FIG. 7(*a*) shows a selected state.
Figure 7:
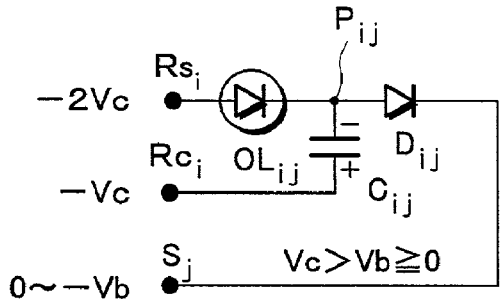
Figure 7:
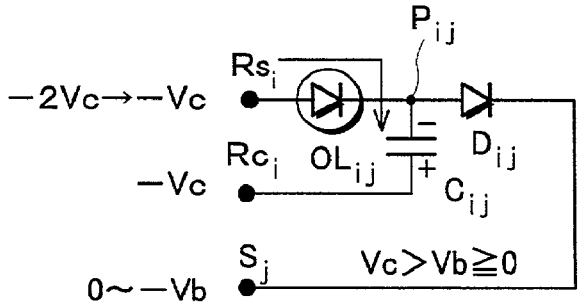

The following describes the driving method of the EL panel with reference to FIG. 6 and FIG. 7(*a*) through FIG. 7(*c*). FIG. 6 is a timing chart showing changes in potentials of respective electrodes when driving the EL panel of the present embodiment. FIG. 7(*a*) through FIG. 7(*c*) are schematic drawings showing different states of the pixel $A_{ij}$ when driving the EL panel, in which FIG. 7(*a*) shows a selected state; FIG. 7(*b*) shows a non-selected state 1; and FIG. 7(*c*) shows a non-selected state 2. Indicated by (1) and (2), (3) and (4), and (5) and (6) in FIG. 6 is changes in potentials which are set for the scanning electrodes $Rc_1$ and $Rs_1$, scanning electrodes $Rc_2$ and $Rs_2$, and scanning electrodes $Rc_m$ and $Rs_m$, respectively. Further, indicated by (7) and (8) in FIG. 6 is changes in potentials which are set for signal electrodes $S_1$ and $S_2$, respectively. Further, indicated in (9), (10), (11), and (12) in FIG. 6 is changes in potentials at common terminals $P_{11}$, $P_{12}$, $P_{21}$, and $P_{22}$.

In order to drive the EL panel, the rows are selected successively from the first row to the mth row, so as to charge capacitors C of pixels A in each row. The pixels A, which became non-selected after the capacitors C are charged, allow the organic EL elements OL to emit light while the stored charge in the capacitors C is discharged. Note that, the period from the selection of the first row to the selection of the mth row makes up one field period.

The following explains driving of the EL panel in more detail. When the first row is selected, the potential of the scanning electrode $Rc_1$ is brought to 0, and the potential of the scanning electrode $Rs_1$ is brought to −Vc (Vc>0) ((1) and (2) in FIG. 6), while setting signal potentials for the respective signal electrodes $S_j$. The signal potentials are in accordance with tones to be displayed by the pixel $A_{1j}$ of the first row. Here, a pixel $A_{11}$ and a pixel $A_{12}$ are set to −V1 (V1>0) and −V4 (V4>0), respectively ((7) and (8) in FIG. 6). Here, the potentials of the respective common terminals $P_{11}$ and $P_{12}$ of the pixels $A_{11}$ and $A_{12}$ gradually decrease, from the potentials before the selection, to reach the signal potentials −V1 and −V4, respectively ((9) and (10) in FIG. 6). Note that, a common signal potential will be indicated by −Va. Also, −Vc is smaller than minimum value −Vb of the signal potential −Va (Vc>Vb≧Va≧0).

The state (selected state) where the pixel $A_{ij}$ is selected is as shown in FIG. 7(*a*). In the selected state, the potentials of the scanning electrode $Rc_i$ and the signal electrode $S_j$ are set to 0 and −Va, respectively. Thus, a potential difference of a forward potential state (conduction state) is applied to the diode element $D_{ij}$, with the result that a current is flown through the diode element $D_{ij}$. Further, a charge according to the signal potential −Va is stored in the capacitor $C_{ij}$. Here, a negative charge is injected into the electrode of the capacitor $C_{ij}$ on the side of the common terminal $P_{ij}$. In this case, since −Vc is smaller than minimum value −Vb of the signal potential −Va, a potential difference of a reverse potential state (non-conduction state) is applied to the organic EL element $OL_{ij}$. Thus, no current is flown through the organic EL element $OL_{ij}$, and no light is emitted therefrom.

Then, before shifting to the second row, the potential of the scanning electrode $Rc_i$ and the potential of the scanning electrode $Rs_i$ are set to −Vc and −2Vc, respectively (FIG. 7(*b*), non-selected state 1) The potential −Vc of the scanning electrode $Rc_i$ is smaller than −Vb, which is the minimum value of the signal electrode $S_j$, and there is a potential difference −Va in the capacitor $C_{ij}$, and therefore, in the non-selected state 1, a potential difference of a reverse potential state (non-conduction state) is applied to the diode element $D_{ij}$. Accordingly, there is no flow of charge in and out of the capacitor $C_{ij}$ through the diode element $D_{ij}$. Further, the common terminal $P_{ij}$ comes to have a potential (−Va −Vc) as a result. Even in this state, the potential −2Vc of the scanning electrode $Rs_i$ is smaller than the potential (−Va −Vc) of the common terminal $P_{ij}$, and thus a potential difference of a reverse potential state (non-conduction state) is applied to the organic EL element $OL_{ij}$. As a result, there is no current flow through the organic EL element $OL_{ij}$, and no light is emitted therefrom.

Then, a transition occurs from the non-selected period 1 to the non-selected period 2. The non-selected state may have any duration above 0. Afterward, the potential of the scanning electrode $Rs_i$ is gradually increased from −2Vc to −Vc, before the pixel $A_{ij}$ takes the next selected state (FIG. 7(*c*), non-selected state 2). Here, the potential of the scanning electrode $Rc_i$ is maintained at −Vc. As a result, at the time when the potential of the scanning electrode $Rs_i$ becomes smaller than the potential (−Va −Vc) of the common terminal $P_{ij}$, a potential difference of a forward potential (conduction state) is applied to the organic EL element $OL_{ij}$.

Here, if the capacitor $C_{ij}$ is storing charge which would generate a potential difference at or above the forward ON potential of the organic EL element $OL_{ij}$, the charge will be released via the organic EL element $OL_{ij}$, starting from the time when the potential of the scanning electrode $Rs_i$ becomes smaller than the potential (−Va −Vc) of the common terminal $P_{ij}$, until the potential of the scanning electrode $Rs_i$ becomes −Vc. While this is occurring, the organic EL element $OL_{ij}$ emits light. That is, in the non-selected state 2, the organic EL element $OL_{ij}$ emits light by the current flow according to the stored charge in the capacitor $C_{ij}$ (current according to the signal potential) through the organic EL element $OL_{ij}$. This luminescence by the organic EL element $OL_{ij}$ in the non-selected state 2 allows tone expression according to the signal potential.

The second row is selected after the selected state of the pixel $A_{ij}$ of the first row, or after the following non-selected state 1. Selecting the second row, the potential of the scanning electrode $Rc_2$ and the potential of the scanning electrode $Rs_2$ are set to 0 and −Vc (Vc>0), respectively ((3) and (4) in FIG. 6), while setting signal potentials for the respective signal electrodes $S_j$. Here, a pixel $A_{21}$ and a pixel $A_{22}$ are set to −V4 and −V2 (V2>0), respectively ((11) and (12) in FIG. 6). Then, in the same manner as above, a pixel $A_{22}$ is set to the non-selected state 1 and the non-selected state 2, so as to drive a pixel $A_{2j}$ of the second row.

Figure 8:
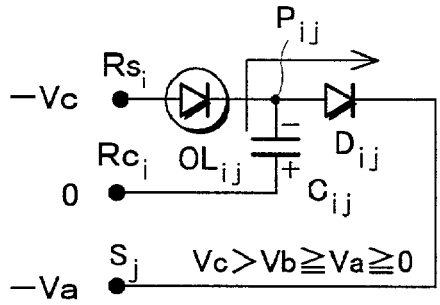
FIG. 8(*a*) through FIG. 8(*c*) are modification examples according to the Second Embodiment of the present invention, corresponding to FIG. 7(*a*) through FIG. 7(*c*), respectively.
Figure 8:
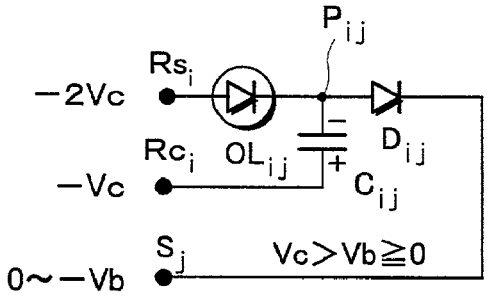
Figure 8:
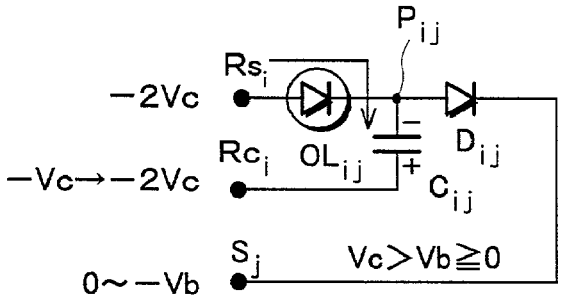

Note that, the foregoing described the case where the potential of the scanning electrode $Rc_i$ is −Vc and the potential of the scanning electrode $Rs_i$ is −2Vc in the non-selected state 1 (FIG. 7(*b*)), and the potential of the scanning electrode $Rs_i$ is varied from −2Vc to −Vc in the non-selected state 2 (FIG. 7(*c*)). However, not limiting to these, as shown in FIG. 8(*a*) through FIG. 8(*c*), the potential of the scanning electrode $Rc_i$ may be −Vc in the non-selected state 1, and the potential of the scanning electrode $Rc_i$ may be varied from −Vc to −2Vc in the non-selected state 2. FIG. 8(*a*) through FIG. 8(*c*) are modification examples of FIG. 7(*a*) through FIG. 7(*c*).

The EL panel of the present embodiment, as in the First Embodiment, may have a structure which does not require the additional resistance. This solves the problem of generated heat by the current flow through the additional resistance, the problem of low luminous efficiency, and the problem of prolonged charging time for charging the additional capacitance, which is induced by the provision of the additional resistance. Further, as with the First Embodiment, luminous efficiency can be improved in the EL panel of the present embodiment.

[Third Embodiment]

Figure 9:
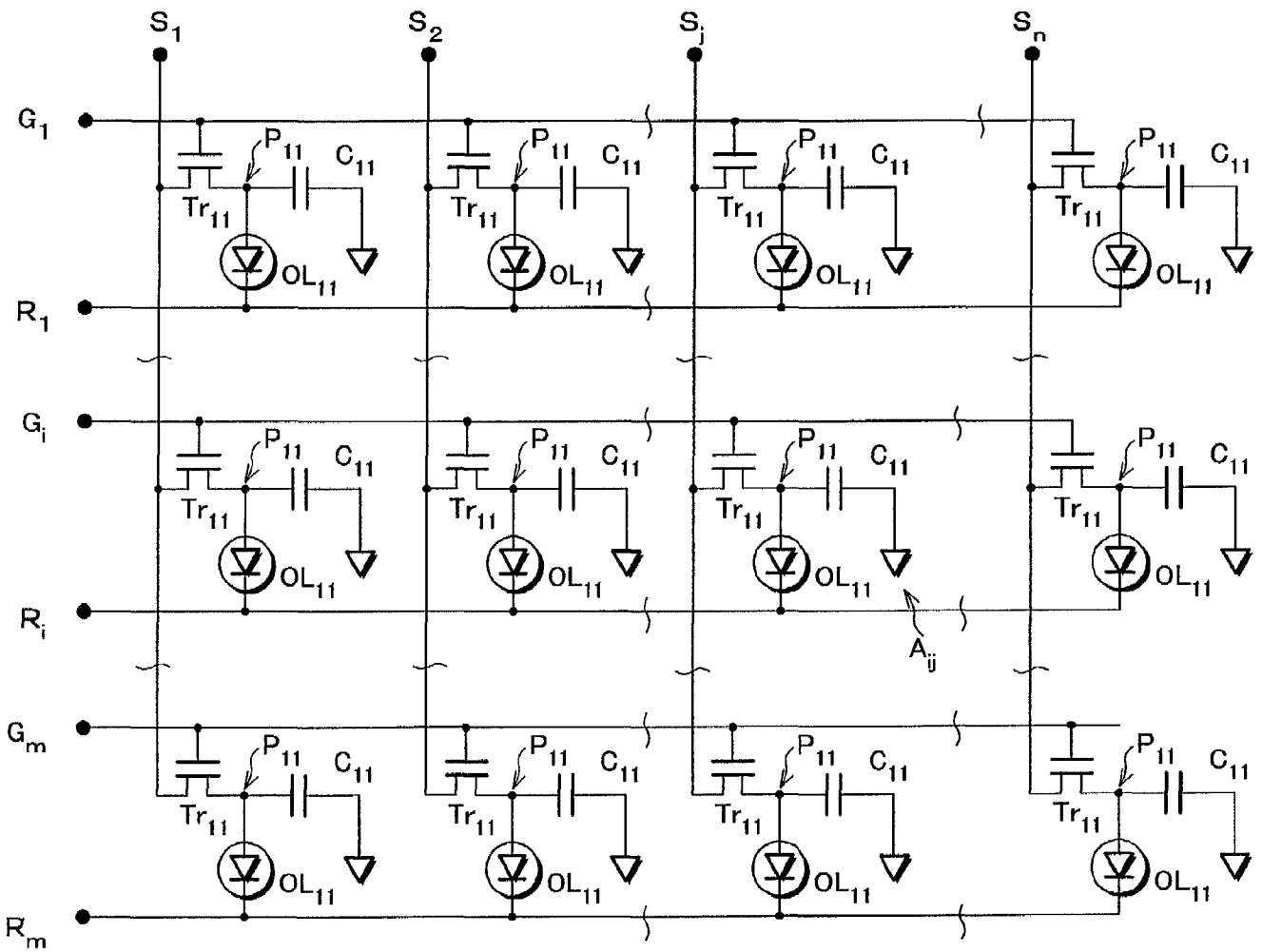
FIG. 9 is a circuit diagram showing an equivalent circuit of pixels in an EL panel according to a Third Embodiment of the present invention.

The present embodiment describes a structure of an EL panel (display panel) and a driving method thereof, which employs FET (Field Effect Transistor) active elements, in particular, TFT (thin film transistors), with reference to FIG. 9 through FIG. 12. The EL panel of the present embodiment has a structure as shown in FIG. 9. FIG. 9 is a circuit diagram showing an equivalent circuit of pixels of the EL panel of the present embodiment.

In the EL panel of the present embodiment, a scanning electrode (second scanning electrode) G and a scanning electrode (first scanning electrode) R are provided for each row. The scanning electrodes G and R are connected to pixels A of each row. Further, the EL panel of the present embodiment includes a signal electrode S for each column. The signal electrode S is connected to the pixels A of each column. That is, the EL panel of the present embodiment includes 2 m electrodes on the scanning side, and n electrodes on the signal (data) side.

A pixel (emitter) $A_{ij}$ of the EL panel includes a TFT element (active element, transistor active element) $Tr_{ij}$, an organic EL element (diode emitting element) $OL_{ij}$, and a capacitor $C_{ij}$. The drain (first terminal) of the TFT element $Tr_{ij}$, the anode (first terminal) of the organic EL element $OL_{ij}$, and one of the electrodes (first terminal) of the capacitor $C_{ij}$ are electrically connected to one another at a common terminal $P_{ij}$. Further, the source (second terminal) of the TFT element $Tr_{ij}$, i.e., the terminal, other than the gate, on the other side of the common terminal $P_{ij}$, is connected to the signal electrode $S_j$. The gate (third terminal) of the TFT element $Tr_{ij}$ is connected to a scanning electrode $G_i$. The other electrode (second terminal) of the capacitor $C_{ij}$, i.e., the electrode on the other side of the common terminal $P_{ij}$, is connected to a common GND (ground) terminal (common electrode) which is common to all pixels. The cathode (second terminal) of the organic EL element $OL_{ij}$, i.e., the terminal on the other side of the common terminal $P_{ij}$, is connected to a scanning electrode $R_i$.

Figure 10:
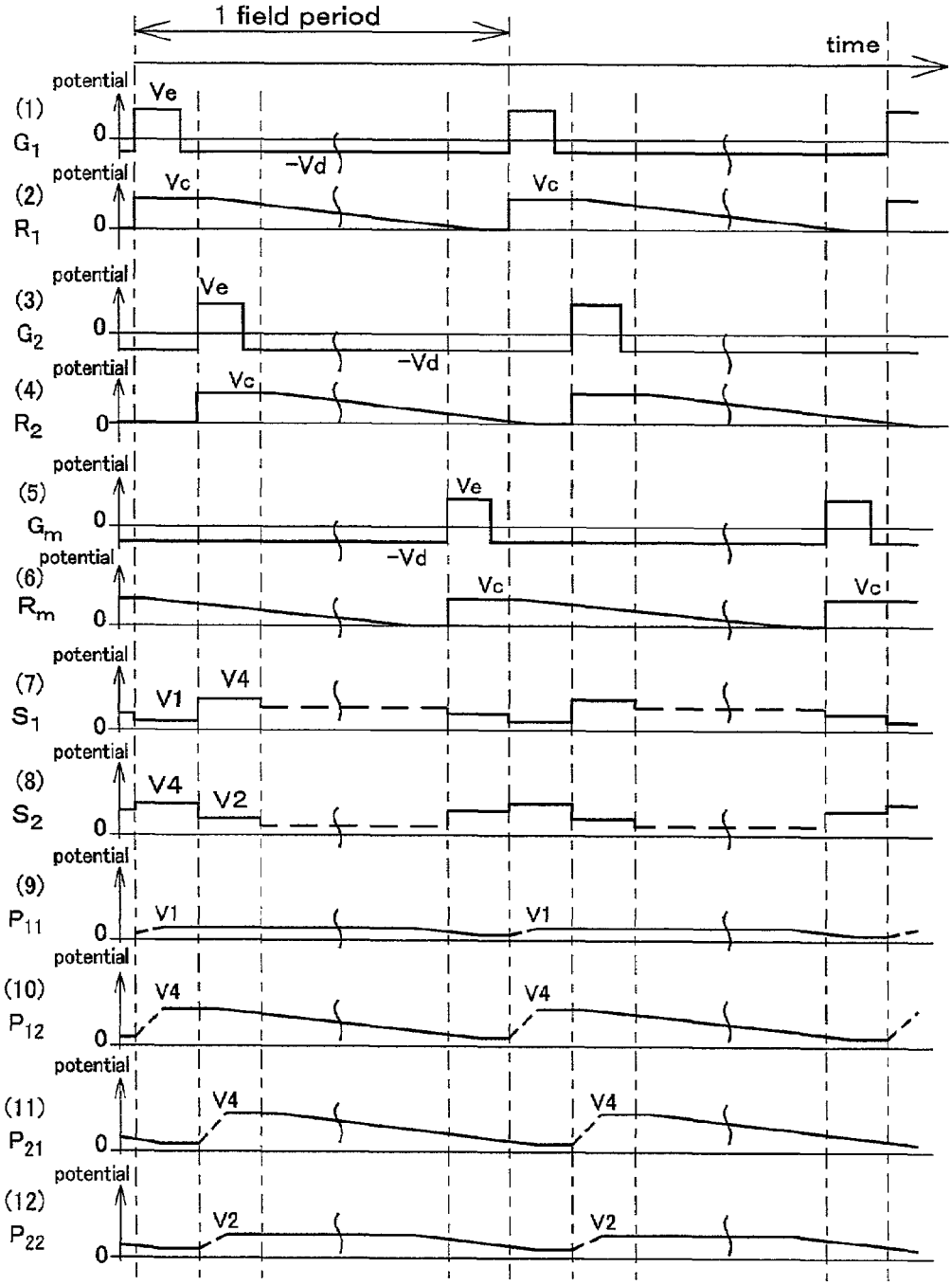
FIG. 10 is a timing chart showing changes in potentials of electrodes when driving the EL panel according to the Third Embodiment of the present invention.
Figure 11:
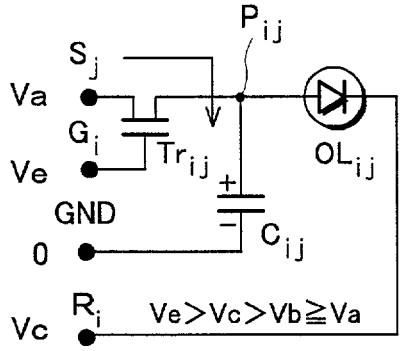
FIG. 11(*a*) through FIG. 11(*c*) are schematic drawings showing states of a pixel when driving the EL panel according to the Third Embodiment of the present invention, in which FIG. 11(*a*) shows a selected state.
Figure 11:
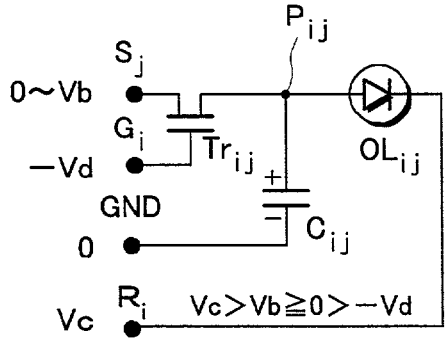
Figure 11:
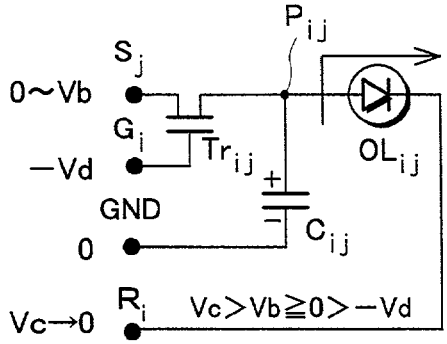

The following describes the driving method of the EL panel with reference to FIG. 10 and FIG. 11(*a*) through FIG. 11(*c*). FIG. 10 is a timing chart showing changes in potentials of respective electrodes when driving the EL panel of the present embodiment. FIG. 11(*a*) through FIG. 11(*c*) are schematic drawings showing different states of the pixel $A_{ij}$ when driving the EL panel, in which FIG. 11(*a*) shows a selected state; FIG. 11(*b*) shows a non-selected state 1; and FIG. 11(*c*) shows a non-selected state 2. Indicated by (1) and (2), (3) and (4), and (5) and (6) in FIG. 10 is changes in potentials which are set for the scanning electrodes $G_1$ and $R_1$, scanning electrodes $G_2$ and $R_2$, and scanning electrodes $G_m$ and $R_m$, respectively. Further, indicated by (7) and (8) in FIG. 10 is changes in potentials which are set for signal electrodes $S_1$ and $S_2$, respectively. Further, indicated in (9), (10), (11), and (12) in FIG. 10 is changes in potentials at common terminals $P_{11}$, $P_{12}$, $P_{21}$, and $P_{22}$.

In order to drive the EL panel, the rows are selected successively from the first row to the mth row, so as to charge capacitors C of pixels A in each row. The pixels A, which became non-selected after the capacitors C are charged, allow the organic EL elements OL to emit light while the stored charge in the capacitors C is discharged. Note that, the period from the selection of the first row to the selection of the mth row makes up one field period.

The following explains driving of the EL panel in more detail. When the first row is selected, the potential of the scanning electrode $G_1$ is brought to Ve (Ve>0), and the potential of the scanning electrode $R_1$ is brought to Vc (Vc>0) ((1) and (2) in FIG. 10). Here, Ve is a potential which can induce a potential difference at or above the threshold potential between the gate and source of the TFT element Tr, and also a potential which switches ON the gate of the TFT element Tr so as to conduct the source and drain of the TFT element Tr. Here, Ve and Vc are related preferably by Ve>Vc.

While this is being carried out, signal potentials are set for the respective signal electrodes $S_j$. The signal potentials are in accordance with tones to be displayed by the pixel $A_{ij}$ of the first row. Here, a pixel $A_{11}$ and a pixel $A_{12}$ are set to V1 (V1>0) and V4 (V4>0), respectively ((7) and (8) in FIG. 10). Here, the potentials of the respective common terminals $P_{11}$ and $P_{12}$ of the pixels $A_{11}$ and $A_{12}$ gradually increase, from the potentials before the selection, to reach the signal potentials V1 and V4, respectively ((9) and (10) in FIG. 10). Note that, a common signal potential will be indicated by Va. Also, Vc is larger than maximum value Vb of the signal potential Va (Vc>Vb≧Va).

Note that, when the active element is the TFT element Tr as in the present embodiment, the signal potential Va may be a negative potential. In particular, when the pixel $A_{ij}$ is to be kept dark (dark display state), it is preferable to set a negative potential for the signal potential Va. This is due to the fact that the OFF resistance of the TFT element Tr is not infinite. Because the OFF resistance of the TFT element Tr is not infinite, a small current (leak current) flows through the TFT element Tr, even when the pixel $A_{ij}$ is not selected (when the TFT element Tr is OFF). Due to crosstalk by this current, there are cases where the dark display state appears slightly bright. In order to realize a desirable (sufficiently) dark display state, it is preferable, as above, to set a negative potential for the signal potential Va to store negative charge on the electrode of the capacitor $C_{ij}$ on the side of the common terminal $P_{ij}$. This cancels out the leak current, thus maintaining a desirable dark state. Note that, since the organic EL element OL itself has the characteristics of the capacitor, the capacitor $C_{ij}$ is not necessarily required to obtain the foregoing functions, as long as a reverse potential can be applied to the organic EL element OL.

The state (selected state) where the pixel $A_{ij}$ is selected is as shown in FIG. 11(*a*). In the selected state, the potential of the scanning electrode $G_i$ Ve, and the source and drain of the TFT element $Tr_{ij}$ are conducted. Further, the signal potential Va is set for the signal electrode $S_j$. As a result, a current is flown through the capacitor $C_{ij}$ via the TFT element $Tr_{ij}$. Further, a charge according to the signal potential Va is stored in the capacitor $C_{ij}$. Here, a positive charge is injected into the electrode of the capacitor $C_{ij}$ on the side of the common terminal $P_{ij}$. In this case, since Vc is larger than maximum value Vb of the signal potential Va, a potential difference of a reverse potential state (non-conduction state) is applied the organic EL element $OL_{ij}$. Thus, no current is flown through the organic EL element $OL_{ij}$, and no light is emitted therefrom.

Then, before shifting to the second row, the potential of the scanning electrode $G_i$ is set to −Vd (−Vd<0). Here, −Vd is a potential which induces a potential difference at or below the threshold value between the gate and source of the TFT element Tr, and also a potential which switches OFF the TFT element Tr so as not to conduct the source and drain of the TFT element Tr. As a result, the common terminal $P_{ij}$ and the signal electrode $S_j$ become non-conducted. Accordingly, there is no flow of charge in and out of the capacitor $C_{ij}$ through the TFT element $Tr_{ij}$. Further, even in this state, the potential of the scanning electrode $R_i$ is maintained at Vc, and a potential difference of a reverse potential state (non-conduction state) is applied to the organic EL element $OL_{ij}$. As a result, there is no current flow through the organic EL element $OL_{ij}$, and no light is emitted therefrom.

Then, a transition occurs from the non-selected period 1 to the non-selected period 2. The non-selected state may have any duration above 0. Afterward, the potential of the scanning electrode $Rs_i$ is gradually decreased from Vc to 0, before the pixel $A_{ij}$ takes the next selected state (FIG. 11(*c*), non-selected state 2). Here, the potential of the scanning electrode $G_i$ is maintained at −Vd. As a result, at the time when the potential of the scanning electrode $R_i$ becomes smaller than the potential Va of the common terminal $P_{ij}$, a potential difference of a forward potential state (conduction state) is applied to the organic EL element $OL_{ij}$.

Here, if the capacitor $C_{ij}$ is storing charge which would generate a potential difference at or above the forward ON potential of the organic EL element $OL_{ij}$, the charge will be released via the organic EL element $OL_{ij}$, starting from the time when the potential of the scanning electrode $R_i$ becomes smaller than the potential Va of the common terminal $P_{ij}$, until the potential of the scanning electrode $R_i$ becomes 0. While this is occurring, the organic EL element $OL_{ij}$ emits light. That is, in the non-selected state 2, the organic EL element $OL_{ij}$ emits light by the current flow (current according to the signal potential) according to the stored charge in the capacitor $C_{ij}$ through the organic EL element $OL_{ij}$. This luminescence by the organic EL element $OL_{ij}$ in the non-selected state 2 allows tone expression according to the signal potential.

The current through the organic EL element $OL_{ij}$ is based on a potential difference between the cathode and anode of the organic EL element $OL_{ij}$. The potential difference Vf generated between the cathode and anode of the organic EL element $OL_{ij}$ is $$Vf=Vg+Qf/Cf-Vr,$$

where Vg is the potential of the GND, Qf is the charge stored in the capacitor $C_{ij}$, Cf is the capacitance of the capacitor $C_{ij}$, and Vr is the potential of the scanning electrode $R_i$. Here, current If flowing between the cathode and anode of the organic EL element $OL_{ij}$ is the change in quantity of the stored charge in the capacitor $C_{ij}$. Thus, by differentiating the foregoing equation with respect to time, the potential of the GND, which is a constant, will be cancelled, so that $$d(Vf)/dt=d(Qf/Cf)/dt-d(Vr)/dt, \text{ and therefore } Cf\times d(Vf)/dt=d(Qf)/dt-Cf\times d(Vr)/dt=If-Cf\times d(Vrs)/dt.$$

Here, when the potential difference Vf generated between the cathode and anode of the organic EL element $OL_{ij}$ is practically fixed, d(Vd)/dt will be almost 0, and thus the current If flowing through the cathode and anode of the organic EL element $OL_{ij}$ becomes $$If=Cf\times d(Vr)/dt.$$

That is, the current flow through the organic EL element $OL_{ij}$ can be controlled by controlling the rate of change of the potential of the scanning electrode $R_i$ from 2Vc to Vc, i.e., by controlling the gradient of potential change of the scanning electrode $R_i$.

Thus, the gradient of a potential change of the scanning electrode $R_i$ is set so that the current through the organic EL element $OL_{ij}$ takes a current value which causes the organic EL element $OL_{ij}$ to emit light with high luminous efficiency. This makes it possible to always drive the organic EL element $OL_{ij}$ with high luminous efficiency, thereby improving luminous efficiency of the EL panel.

The second row is selected after the selected state of the pixel $A_{ij}$ of the first row, or after the following non-selected state 1. Selecting the second row, the potential of the scanning electrode $G_2$ and the potential of the scanning electrode $R_2$ are set to Ve and Vc (Vc>0), respectively ((3) and (4) in FIG. 10), while setting signal potentials for the respective signal electrodes $S_j$. Here, a pixel $A_{21}$ and a pixel $A_{22}$ are set to V4 and V2 (V2>0), respectively ((11) and (12) in FIG. 10). Then, in the same manner as above, the pixel $A_{22}$ is set to the non-selected state 1 and the non-selected state 2, so as to drive a pixel $A_{2j}$ of the second row.

Figure 12:
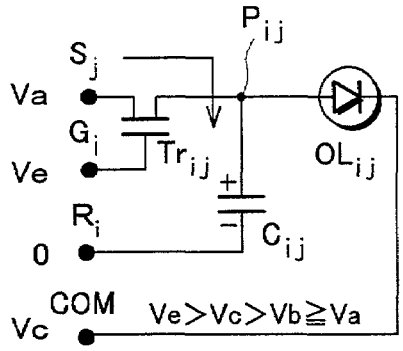
FIG. 12(*a*) through FIG. 12(*c*) are modification examples according to the Third Embodiment of the present invention, corresponding to FIG. 11(*a*) through FIG. 11(*c*), respectively.
Figure 12:
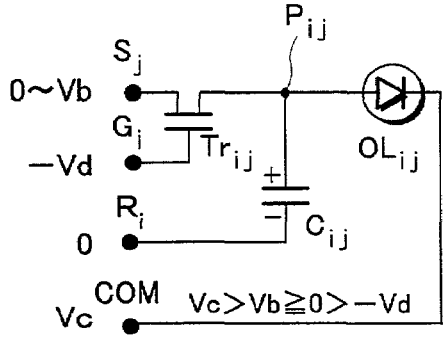
Figure 12:
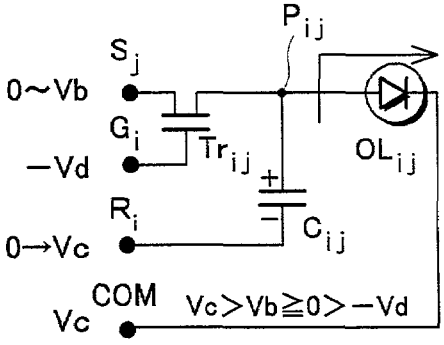

Note that, the foregoing described the case where the potential of the scanning electrode $R_i$ is Vc in the non-selected state 1 (FIG. 11(*b*)), and the potential of the scanning electrode $R_i$ varied from Vc to 0 in the non-selected state 2 (FIG. 11(*c*)). However, not limiting to these, a structure and a driving method as shown in FIG. 12(*a*) through FIG. 12(*c*) may be adopted as well. FIG. 12(*a*) through FIG. 12(*c*) are schematic drawings showing different states of the pixel $A_{ij}$ when driving an EL panel according to one modification example of the present embodiment, in which FIG. 12(*a*), FIG. 12(*b*), and FIG. 12(*c*) show the selected state, the non-selected state 1, and the non-selected state 2, respectively.

In this EL panel, the electrode of the capacitor $C_{ij}$ on the other side of the common terminal $P_{ij}$ is connected to the scanning electrode $R_i$. The cathode of the organic EL element $OL_{ij}$, i.e., the terminal on the other side of the common terminal $P_{ij}$, is connected to a COM (common) terminal (common electrode) which is common to all pixels A. The other structure is the same as that shown in FIG. 11(*a*) through FIG. 11(*c*).

In this EL panel, the potential of the COM (common) terminal is always set at Vc. In the selected state, the scanning electrode $R_i$ is set to 0, so as to charge the capacitor $C_{ij}$ as above (FIG. 12(*a*)). Then, a transition to the non-selected state 2 occurs via the non-selected state 1 (FIG. 12(*b*)) as above. In the non-selected state 2, the potential of the scanning electrode $R_i$ is varied from 0 to Vc (FIG. 12(*c*)). As a result, the organic EL element $OL_{ij}$ emits light as above.

Figure 29:
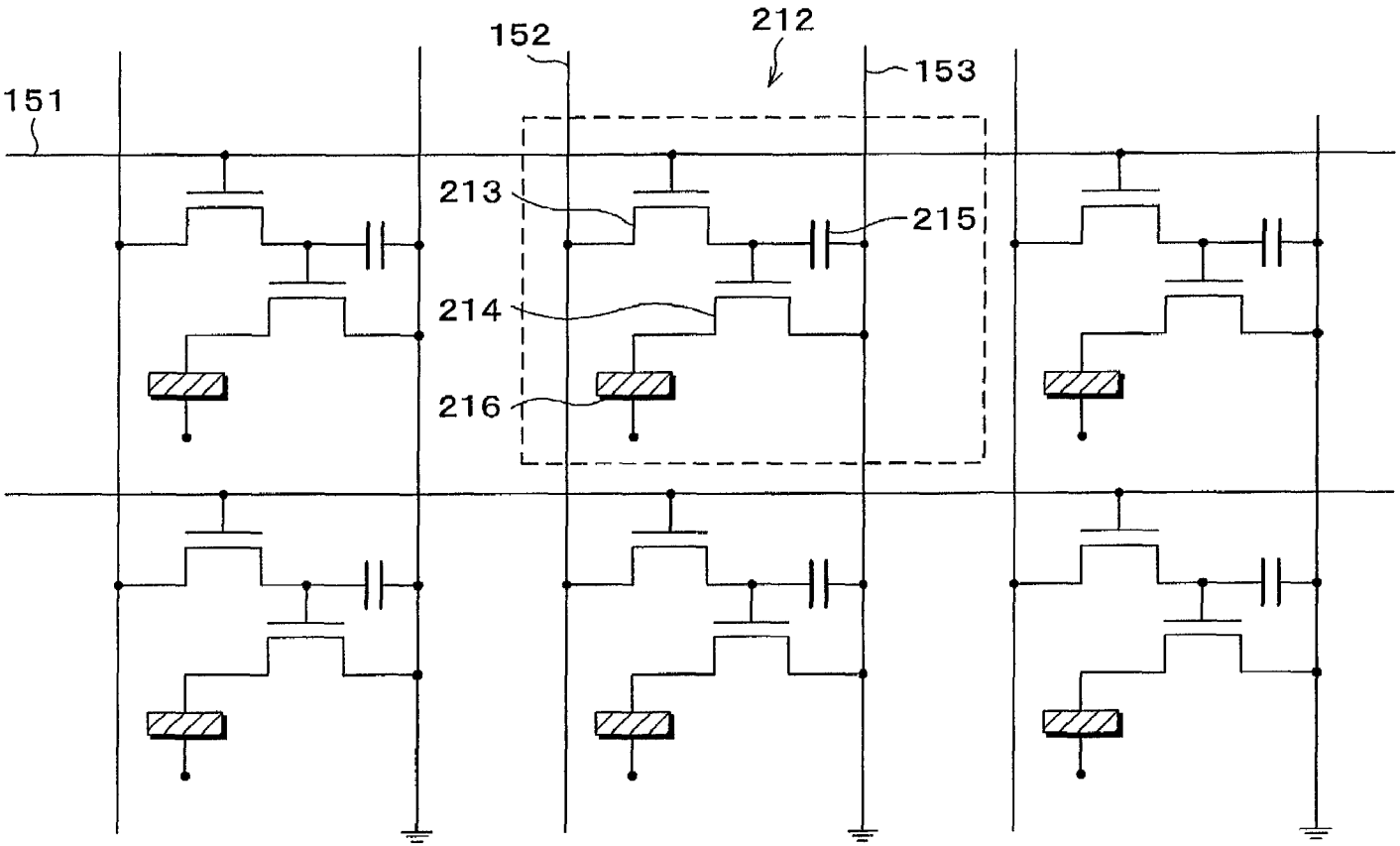
FIG. 29 (PRIOR ART)
FIG. 29 is a circuit diagram showing an equivalent circuit of pixels in a conventional active-matrix-type EL panel using TFTs.
Figure 30:
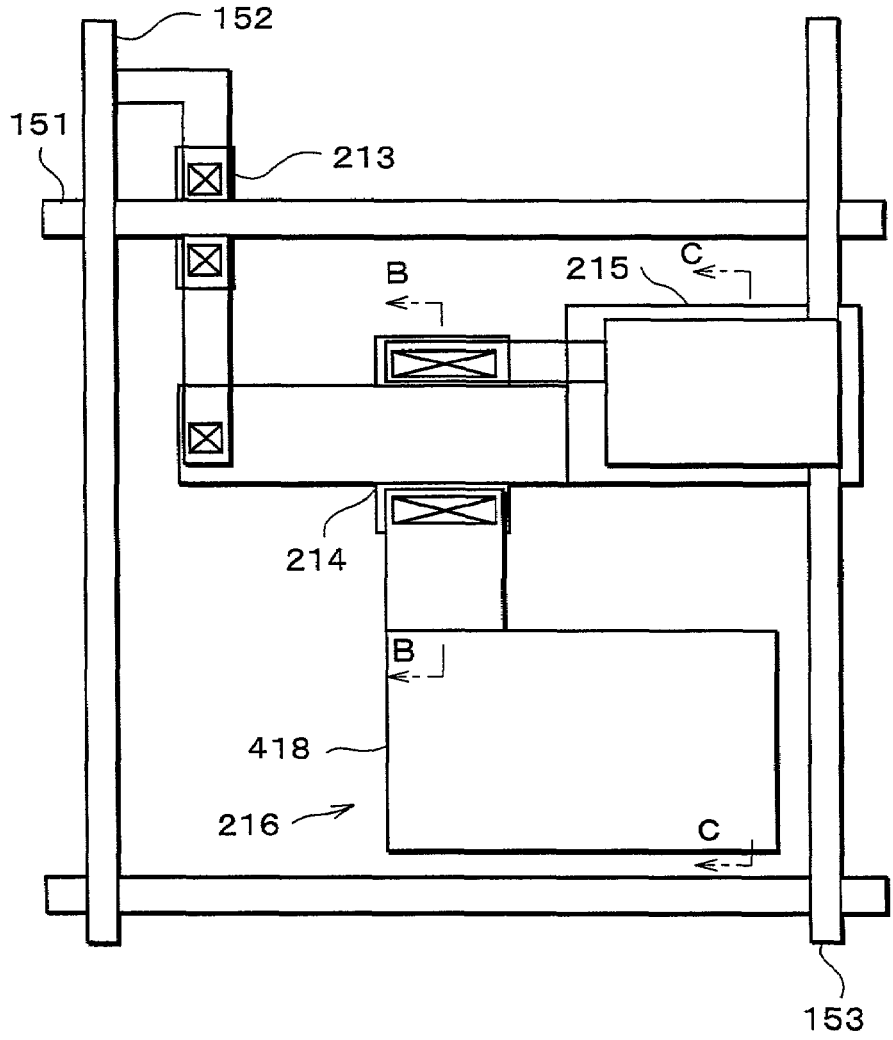
FIG. 30 (PRIOR ART)
FIG. 30 is a plan view of a pixel of the conventional active-matrix-type EL panel using TFTs.

As described, in the structure of the pixel $A_{ij}$ of the EL panel of the present embodiment, unlike the structure of the pixel of the EL panel employing TFTs as described in the foregoing BACKGROUND OF THE INVENTION section (FIG. 29), the organic EL element $OL_{ij}$ is driven by the stored charge in the capacitor $C_{ij}$ to emit light. That is, unlike the conventional structure which drives the organic EL element by controlling voltage, the organic EL element $OL_{ij}$ is driven by controlling current. As a result, it is possible to stabilize luminance of the organic EL element $OL_{ij}$, compared with the conventional structure.

The foregoing described the case where the signal potential is used as the signal for expressing tones by controlling the luminance of the pixel $A_{ij}$. However, this structure may cause variance in luminance of emitted light among pixels, due to variance in potential drop between source and drain of the TFT element $Tr_{ij}$ among pixels, or variance in capacitance of the capacitor $C_{ij}$ among pixels. In order to suppress these variances, a signal current may be used as the signal for expressing tones, instead of the foregoing signal potential. That is, the column driver 102 (FIG. 18) for driving the signal electrode $S_{ij}$ is changed from a potential-control-type to a current-control-type. This allows the stored charge in the capacitor $C_{ij}$ to be accurately controlled, thus suppressing variance in luminance of emitted light among pixels, compared with the conventional structure.

Further, as with the First or Second Embodiment, such a current which would bring the optimum luminous efficiency for the organic EL element $OL_{ij}$ can be flown through the organic EL element $OL_{ij}$, thus realizing the EL panel with desirable luminous efficiency.

[Fourth Embodiment]

Figure 13:
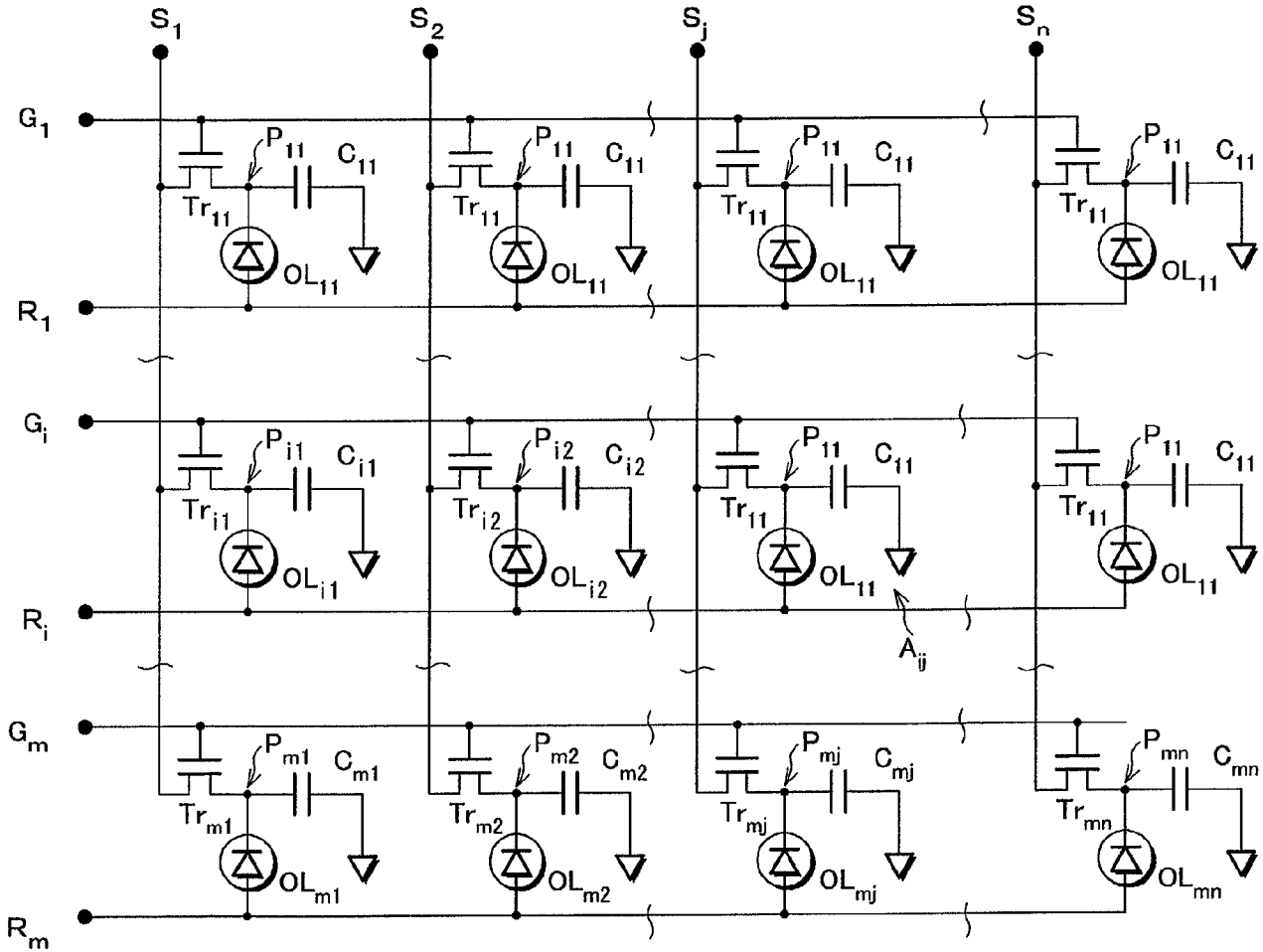
FIG. 13 is a circuit diagram showing an equivalent circuit of pixels in an EL panel according to a Fourth Embodiment of the present invention.

The present embodiment describes a structure of an EL panel and a driving method thereof, when the polarity of the organic EL element $OL_{ij}$ is changed with respect to the EL panel of the Third Embodiment, with reference to FIG. 13 through FIG. 16. The EL panel (display panel) of the present embodiment has a structure as shown in FIG. 13. FIG. 13 is a circuit diagram showing an equivalent circuit of pixels of the EL panel of the present embodiment.

The EL panel of the present embodiment has the same structure as that of the EL panel of the Third Embodiment, except that the polarity of the organic EL element $OL_{ij}$ is reversed with respect to the EL panel of the Third Embodiment.

That is, in a pixel (emitter) $A_{ij}$ of the EL panel, the drain (first terminal) of TFT element (active element, transistor active element) $Tr_{ij}$, the cathode (first terminal) of the organic EL element (diode emitting element) $OL_{ij}$, and one of the electrodes (first terminal) of the capacitor $C_{ij}$ are electrically connected to one another at a common terminal $P_{ij}$. Further, the source (second terminal) of the TFT element $Tr_{ij}$, i.e., the terminal, other than the gate, on the other side of the common terminal $P_{ij}$, is connected to the signal electrode $S_j$. The gate (third terminal) of the TFT element $Tr_{ij}$ is connected to scanning electrode (second scanning electrode) $G_i$. The other electrode (second terminal) of the capacitor $C_{ij}$, i.e., the electrode on the other side of the common terminal $P_{ij}$, is connected to a common GND (ground) terminal (common electrode) which is common to all pixels A. The anode (second terminal) of the organic EL element $OL_{ij}$, i.e., the terminal on the other side of the common terminal $P_{ij}$, is connected to the scanning electrode (first scanning electrode) $R_i$.

Figure 14:
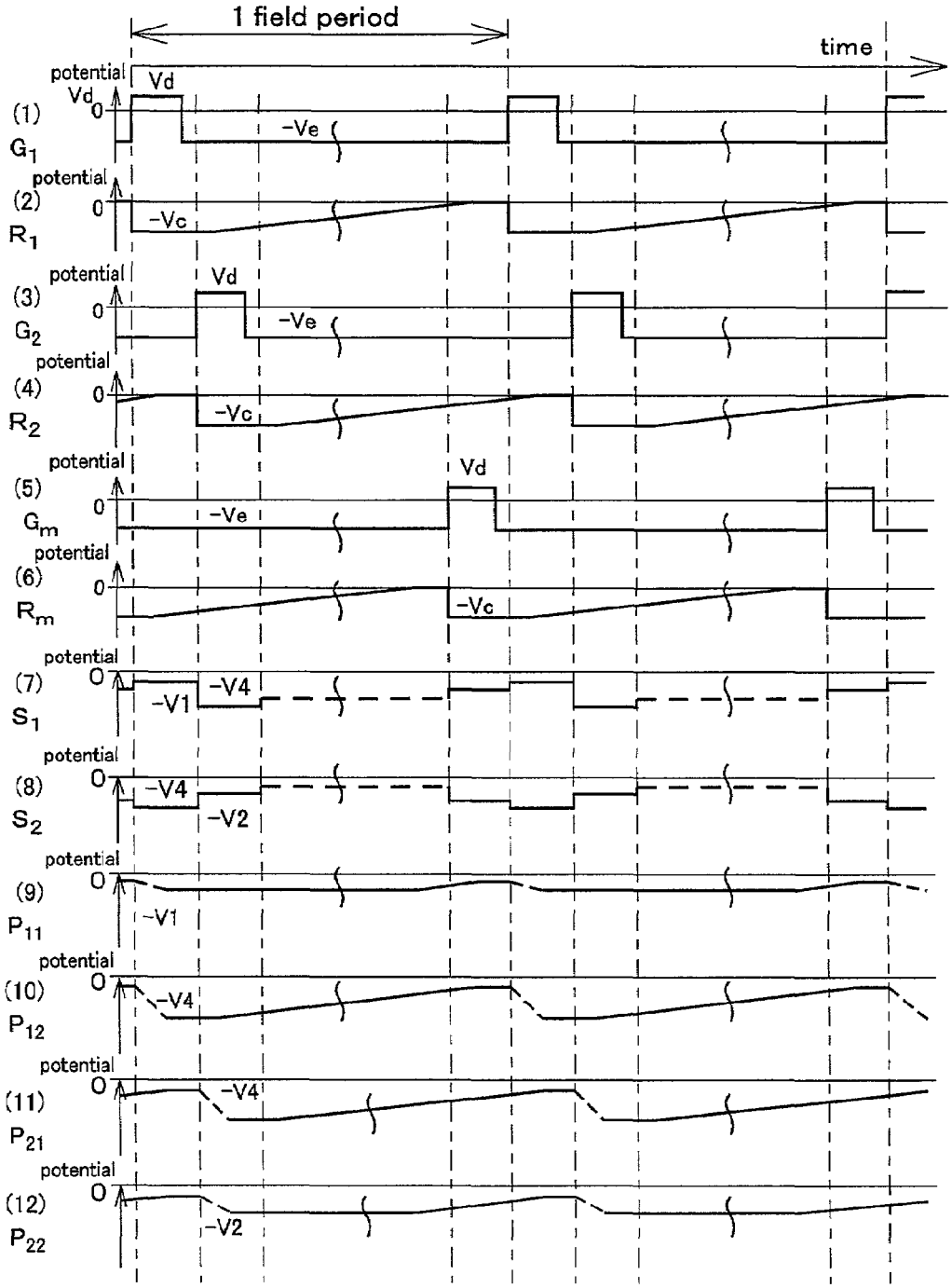
FIG. 14 is a timing chart showing changes in potentials of electrodes when driving the EL panel according to the Fourth Embodiment of the present invention.
Figure 15:
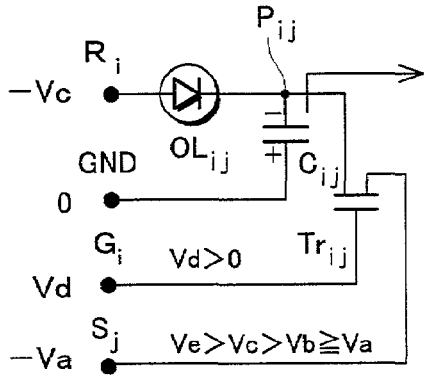
FIG. 15(*a*) through FIG. 15(*c*) are schematic drawings showing states of a pixel when driving the EL panel according to the Fourth Embodiment of the present invention, in which FIG. 15(*a*) shows a selected state.
Figure 15:
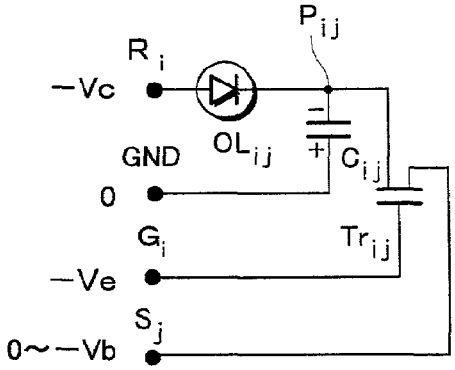
Figure 15:
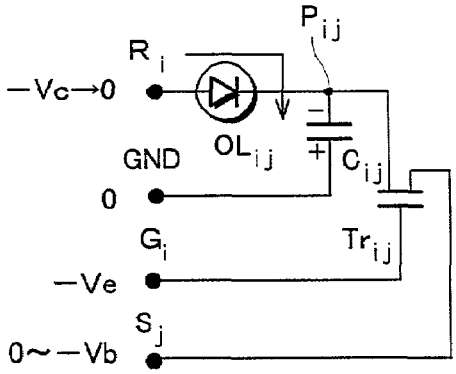

The following describes the driving method of the EL panel with reference to FIG. 14 and FIG. 15(*a*) through FIG. 15(*c*). FIG. 14 is a timing chart showing changes in potentials of respective electrodes when driving the EL panel of the present embodiment. FIG. 15(*a*) through FIG. 15(*c*) are schematic drawings showing different states of the pixel $A_{ij}$ when driving the EL panel, in which FIG. 15(*a*) shows a selected state; FIG. 15(*b*) shows a non-selected state 1; and FIG. 15(*c*) shows a non-selected state 2. Indicated by (1) and (2), (3) and (4), and (5) and (6) in FIG. 14 is changes in potentials which are set for the scanning electrodes $G_1$ and $R_1$, scanning electrodes $G_2$ and $R_2$, and scanning electrodes $G_m$ and $R_m$, respectively. Further, indicated by (7) and (8) in FIG. 14 is changes in potentials which are set for signal electrodes $S_1$ and $S_2$, respectively. Further, indicated in (9), (10), (11), and (12) in FIG. 14 is changes in potentials at common terminals $P_{11}$, $P_{12}$, $P_{21}$, and $P_{22}$.

In order to drive the EL panel, the rows are selected successively from the first row to the mth row, so as to charge capacitors C of pixels A in each row. The pixels A, which became non-selected after the capacitors C are charged, allow the organic EL elements OL to emit light while the stored charge in the capacitors C is discharged. Note that, the period from the selection of the first row to the selection of the mth row makes up one field period.

The following explains driving of the EL panel in more detail. When the first row is selected, the potential of the scanning electrode $G_1$ is brought to Vd (Vd>0), and the potential of the scanning electrode $R_1$ is brought to −Vc (Vc>0) ((1) and (2) in FIG. 14). Here, Vd is a potential which can induce a potential difference at or above the threshold potential between the gate and source of the TFT element Tr, and also a potential which switches ON the gate of the TFT element Tr so as to conduct the source and drain of the TFT element Tr.

While this is being carried out, signal potentials are set for the respective signal electrodes $S_j$. The signal potentials are in accordance with tones to be displayed by the pixel $A_{ij}$ of the first row. Here, a pixel $A_{11}$ and a pixel $A_{12}$ are set to −V1 (V1>0) and −V4 (V4>0), respectively ((7) and (8) in FIG. 14). Here, the potentials of the respective common terminals $P_{11}$ and $P_{12}$ of the pixels $A_{11}$ and $A_{12}$ gradually decrease, from the potentials before the selection, to reach the signal potentials −V1 and −V4, respectively ((9) and (10) in FIG. 14). Note that, a common signal potential will be indicated by −Va. Also, −Vc is larger than minimum value −Vb of the signal potential −Va, i.e., the absolute value Vc of −Vc is larger than the maximum value Vb of the absolute value Va of the signal potential −Va (Vc>Vb≧Va).

The state (selected state) where the pixel $A_{ij}$ is selected is as shown in FIG. 15(*a*). In the selected state, the potential of the scanning electrode $G_i$ is Vd, and the source and drain of the TFT element $Tr_{ij}$ are conducted. Further, the signal potential Va is set for the signal electrode $S_j$. As a result, a current is flown through the capacitor $C_{ij}$ via the TFT element $Tr_{ij}$. Further, a charge according to the signal potential Va is stored in the capacitor $C_{ij}$. Here, a negative charge is injected into the electrode of the capacitor $C_{ij}$ on the side of the common terminal $P_{ij}$. In this case, since −Vc is smaller than minimum value −Vb of the signal potential −Va, a potential difference of a reverse potential state (non-conduction state) is applied to the organic EL element $OL_{ij}$. Thus, no current is flown through the organic EL element $OL_{ij}$, and no light is emitted therefrom.

Then, before shifting to the second row, the potential of the scanning electrode $G_i$ is set to −Ve (−Ve<0). Here, −Ve is a potential which induces a potential difference at or below the threshold value between the gate and source of the TFT element Tr, and also a potential which switches OFF the TFT element Tr so as not to conduct the source and drain of the TFT element Tr. As a result, the common terminal $P_{ij}$ and the signal electrode $S_j$ become non-conducted. Accordingly, there is no flow of charge in and out of the capacitor $C_{ij}$ through the TFT element $Tr_{ij}$. Further, even in this state, the potential of the scanning electrode $R_i$ is maintained at −Vc, and a potential difference of a reverse potential state (non-conduction state) is applied to the organic EL element $OL_{ij}$. As a result, there is no current flow through the organic EL element $OL_{ij}$, and no light is emitted therefrom.

Then, a transition occurs from the non-selected period 1 to the non-selected period 2. The non-selected state may have any duration above 0. Afterward, the potential of the scanning electrode $Rs_i$ is gradually decreased from Vc to 0, before the pixel $A_{ij}$ takes the next selected state (FIG. 15(*c*), non-selected state 2). Here, the potential of the scanning electrode $G_i$ is maintained at −Vd. As a result, at the time when the potential of the scanning electrode $R_i$ becomes smaller than the potential −Va of the common terminal $P_{ij}$, a potential difference of a forward potential state (conduction state) is applied to the organic EL element $OL_{ij}$.

Here, if the capacitor $C_{ij}$ is storing charge which would generate a potential difference at or above the forward ON potential of the organic EL element $OL_{ij}$, the charge will be released via the organic EL element $OL_{ij}$, starting from the time when the potential of the scanning electrode $R_i$ becomes smaller than the potential −Va of the common terminal $P_{ij}$, until the potential of the scanning electrode $R_i$ becomes 0. While this is occurring, the organic EL element $OL_{ij}$ emits light. That is, in the non-selected state 2, the organic EL element $OL_{ij}$ emits light by the current flow according to the stored charge in the capacitor $C_{ij}$ (current according to the signal potential) through the organic EL element $OL_{ij}$. This luminescence by the organic EL element $OL_{ij}$ in the non-selected state 2 allows tone expression according to the signal potential.

The second row is selected after the selected state of the pixel $A_{ij}$ of the first row, or after the following non-selected state 1. Then, the potential of the scanning electrode $G_2$ and the potential of the scanning electrode $R_2$ are set to Vd and −Vc (Vc>0), respectively ((3) and (4) in FIG. 14), while setting signal potentials for the respective signal electrodes $S_j$. Here, a pixel $A_{21}$ and a pixel $A_{22}$ are set to −V4 and −V2 (V2>0), respectively ((11) and (12) in FIG. 14). Then, in the same manner as above, the pixel $A_{22}$ is set to the non-selected state 1 and the non-selected state 2, so as to drive a pixel $A_{2j}$ of the second row.

Figure 16:
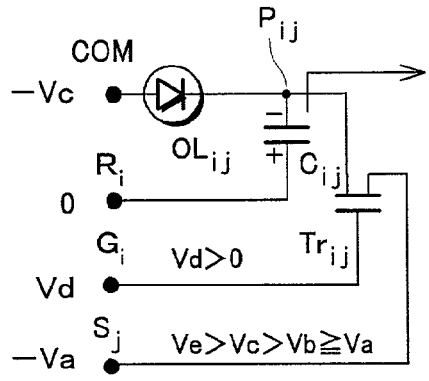
FIG. 16(*a*) through FIG. 16(*c*) are modification examples according to the Fourth Embodiment of the present invention, corresponding to FIG. 15(*a*) through FIG. 15(*c*), respectively.
Figure 16:
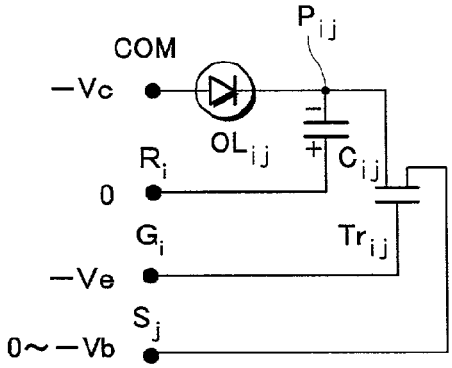
Figure 16:
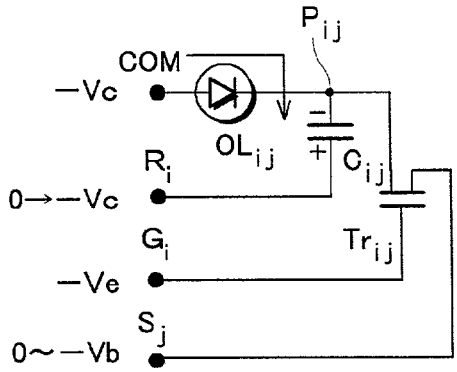

Note that, the foregoing described the case where the potential of the scanning electrode $R_i$ is −Vc in the non-selected state 1 (FIG. 15(*b*)), and the potential of the scanning electrode $R_i$ varied from −Vc to 0 in the non-selected state 2 (FIG. 15(*c*)). However, not limiting to these, a structure and a driving method as shown in FIG. 16(*a*) through FIG. 16(*c*) may be adopted as well. FIG. 16(*a*) through FIG. 16(*c*) are schematic drawings showing different states of the pixel $A_{ij}$ when driving an EL panel according to one modification example of the present embodiment, in which FIG. 16(*a*), FIG. 16(*b*), and FIG. 16(*c*) show the selected state, the non-selected state 1, and the non-selected state 2, respectively.

In this EL panel, the electrode of the capacitor $C_{ij}$ on the other side of the common terminal $P_{ij}$ is connected to the scanning electrode $R_i$. The anode of the organic EL element $OL_{ij}$, i.e., the terminal on the other side of the common terminal $P_{ij}$, is connected to a COM (common) terminal (common electrode) which is common to all pixels A. The other structure is the same as that of FIG. 15(*a*) through FIG. 15(*c*).

Further, in this EL panel, the potential of the COM (common) terminal is always set at −Vc. In the selected state, the scanning electrode $R_i$ is set to 0, so as to charge the capacitor $C_{ij}$ as above (FIG. 16(*a*)). Then, a transition occurs to the non-selected state 2 via the non-selected state 1 (FIG. 16(*b*)) as above. In the non-selected state 2, the potential of the scanning electrode $R_i$ is varied from 0 to −Vc (FIG. 16(*c*)). As a result, the organic EL element $OL_{ij}$ emits light as above.

In the EL panel of the present embodiment, as with the Third Embodiment, the organic EL element $OL_{ij}$ may be driven by controlling current, so as to stabilize luminance of the organic EL element $OL_{ij}$ than conventionally. Further, by using the signal current, instead of the signal potential, for expressing tones, the stored charge in the capacitor $C_{ij}$ can be accurately controlled, thus suppressing variation in luminance of emitted light among pixels, compared with conventionally.

Further, as with the First through Third Embodiments, such a current which would bring the optimum luminous efficiency for the organic EL element $OL_{ij}$ can be flown through the organic EL element $OL_{ij}$, thus realizing the EL panel with desirable luminous efficiency.

Note that, the foregoing explained the case where the organic EL element was used as a model example of the diode emitting element, but the present invention is also applicable to other diode emitting elements such as LED.

As described, the pixel of the EL panel according to the present invention is an emitter which includes: an active element (diode element D, TFT element Tr) having a first terminal and a second terminal, which is adapted to switch between the first terminal and the second terminal; an diode emitting element (organic EL element OL) having a first terminal and a second terminal; and a capacitor (capacitor C) having a first terminal and a second terminal, wherein: the respective first terminals of the active element, the diode emitting element, and the capacitor are electrically connected to one another, and potentials are individually set for the respective second terminals of the active element, the diode emitting element, and the capacitor, while controlling a switching operation of the active element.

It is preferable in this emitter, in the case where the active element is the diode active element (diode element D), that a forward direction of the diode emitting element and a forward direction of the diode active element coincide.

This arrangement allows the capacitor to be charged by setting potentials in the following manner. Namely, the respective potentials of the second terminal of the capacitor and the second terminal of the diode active element are set so as to generate a forward potential difference in the diode active element. Here, the emission of the diode emitting element can be stopped by setting the respective potentials of the second terminal of the diode active element and the second terminal of the diode emitting element so as to generate a reverse potential difference in the diode emitting element.

Further, the diode emitting element can be set to emit light by setting potentials in the following manner. Namely, the potential of the second terminal of the diode active element is set so as to generate a reverse potential difference in the diode active element. In addition, the respective potentials of the second terminal of the capacitor and the second terminal of the diode emitting element are set so as to generate a reverse potential difference in the diode emitting element, and then the respective potentials are gradually varied to reach an equal potential.

This arrangement allows control of the switching operation by way of controlling the respective potentials of the second terminals, thus simplifying the circuit structure.

Alternatively, the active element of the emitter may be the transistor active element (TFT element Tr) having a third terminal for which a potential for controlling switching between the first terminal and the second terminal is set.

This arrangement allows the capacitor to be charged by setting potentials in the following manner. Namely, the respective potentials of the second terminal of the capacitor and the second terminal of the transistor active element are set to potentials for charging the capacitor, while setting such a potential for the third terminal of the transistor active element as to conduct the transistor active element. Here, the emission of the diode emitting element can be stopped by further setting the potential of the second terminal of the diode emitting element so as to generate a reverse potential difference in the diode emitting element.

Further, the diode emitting element can be set to emit light by setting potentials in the following manner. Namely, the third terminal of the transistor active element is set to such a potential as not to conduct the transistor active element. In addition, the respective potentials of the second terminal of the capacitor and the second terminal of the diode emitting element are set so as to generate a reverse potential difference in the diode emitting element, and then the respective potentials are gradually varied to reach an equal potential.

This arrangement allows the second terminal of the capacitor or the second terminal of the diode emitting element to have a constant potential, thus simplifying the circuit structure.

The emitting device is made up of the foregoing emitter and a control section (scanning driver 101, signal driver 102, and controller 103) which controls potentials respectively set for the respective second terminals of the active element, the diode emitting element, and the capacitor, while controlling a switching operation of the active element. The control section operates to store charge in the capacitor by generating a potential difference between the second terminal of the active element and the second terminal of the capacitor, while the active element is in a conduction state, and the control section operates to vary a potential difference between the second terminal of the capacitor and the second terminal of the diode emitting element, so as to discharge the stored charge in the capacitor via the diode emitting element, while the active element is in a non-conduction state.

In the case where the active element of the foregoing emitting device is the diode active element, the control section controls potentials respectively set for the respective second terminals of the diode active element, the diode emitting element, and the capacitor. Further, the control section operates to store charge in the capacitor by generating a potential difference between the second terminal of the diode active element and the second terminal of the capacitor so that a forward potential difference is generated in the diode active element, and the control section operates to vary a potential difference between the second terminal of the capacitor and the second terminal of the diode emitting element so that the stored charge in the capacitor is discharged via the diode emitting element, while generating a potential difference between the second terminal of the diode active element and the second terminal of the capacitor to generate a reverse potential difference in the diode active element.

Further, in the case where the active element of the foregoing emitting device is the transistor active element, the control section controls potentials respectively set for the respective second terminals of the transistor active element, the diode emitting element, and the capacitor, while controlling the switching operation of the transistor active element by controlling the potential set for the third terminal of the transistor active element. Further, the control section operates to store charge in the capacitor by generating a potential difference between the second terminal of the active element and the second terminal of the capacitor, while the transistor active element is in a conduction state, and the control section operates to vary a potential difference between the second terminal of the capacitor and the second terminal of the diode emitting element, so as to discharge the stored charged in the capacitor via the diode emitting element, while the transistor active element is in a non-conduction state.

These emitting devices can control the foregoing operations of the emitter by the control section.

Further, in the case where the active element of the foregoing emitting device is the transistor active element, the control section controls potentials which are respectively set for the respective second terminals of the transistor active element, the diode emitting element, and the capacitor, while controlling the switching operation of the transistor active element by controlling the potential set for the third terminal of the transistor active element. Further, the control section may operate to set potentials respectively for the second terminal of the diode emitting element and the second terminal of the transistor active element, so as to generate a reverse potential difference in the diode emitting element, while the transistor active element is in a conduction state.

When the emitter includes the transistor active element in this arrangement, the polarity of the stored charge in the capacitor is reversed from that discharged via the diode emitting element.

Since the OFF resistance of the transistor active element is not infinite, there are cases where a small current (leak current) flows through the transistor active element even when the transistor active element is OFF. For this reason, for example, the foregoing control where the emitter is disposed in the form of an array to carry out control in the units of row and column may cause crosstalk due to leak current, and even pixels to be kept dark may emit some light.

In contrast, when the emitter is to be kept dark, the foregoing arrangement allows the capacitor to store charge of the opposite polarity to that discharged via the diode emitting element. This charge of the opposite polarity cancels out the leak current, thus maintaining desirable dark state.

In this manner, the foregoing arrangement allows the diode emitting element making up the emitter to store charge of the opposite polarity, and therefore pixels to be kept dark can maintain desirable dark display despite that the OFF resistance of the transistor active element is not infinite, thus improving display quality.

Note that, since the diode emitting element itself has the capacitor characteristics, the capacitor is not necessarily required to obtain the foregoing functions, provided that the diode emitting element has a reverse potential difference.

The foregoing emitter is disposed in the form of an array to make up the display panel (EL panel).

In this arrangement, the emitter, which is capable of accurately emitting light in tone, is disposed in an array, and each emitter makes up a pixel to display an image by the collection of the pixels. The emitter has improved luminous efficiency and therefore it is possible with this display panel to realize image display with sufficient brightness while reducing power consumption.

Further, with the foregoing arrangement, by the use of the emitter capable of stabilizing luminance, the conventional problem of variance in luminance due to variance in TFTs can be suppressed, thus improving quality of a display image.

When the active element of the foregoing display panel is the transistor active element, the second terminal of the capacitor or the second terminal of the diode emitting element of one emitter is electrically connected to the second terminal of the capacitor or the second terminal of the diode emitting element of another emitter, respectively, between the emitters.

With this arrangement, when the emitter includes the transistor active element, one of four second terminals of each emitter (second terminal of the capacitor or second terminal of the diode emitting element) can be commonly used by the emitters. This allows the use of less number of wires, thus simplifying the circuit structure.

When the active element of the display panel is the transistor active element, the second terminal of the diode active element of one emitter is electrically connected to the second terminal of the diode active element of another emitter between the emitters in a column direction of the array, and the second terminal of the capacitor and the second terminal of the diode emitting element of one emitter electrically connected to the second terminal of the capacitor and the second terminal of the diode emitting element of another emitter, respectively, between the emitters in a row direction of the array.

In this arrangement, the emitter having the diode active element is disposed in an array, and each emitter makes up a pixel to display an image by the collection of the pixels. Further, the emitter of each row can be selected or non-selected by independently controlling the respective potentials of the second terminal of the capacitor and the second terminal of the diode emitting element of each emitter in a row unit, and the luminance of the emitter in each column can be set by independently controlling the potential of the second terminal of the diode active element of each emitter in a column unit. As a result, the diode emitting element making up each emitter can emit light with optimum efficiency.

When the active element of the display panel is the transistor active element, the second terminal of the transistor active element of one emitter is electrically connected to the second terminal of the transistor active element of another emitter between the emitters in a column direction of the array, and the second terminal of the diode emitting element and the second terminal of the transistor active element of one emitter are electrically connected to the second terminal of the diode emitting element and the second terminal of the transistor active element of another emitter, respectively, between the emitters in a row direction of the array.

In this arrangement, the emitter having the diode active element is disposed in an array, and each emitter makes up a pixel to display an image by the collection of the pixels. Further, the emitter of each row can be selected or non-selected by independently controlling the potential of the second terminal of the diode emitting element or the capacitor, and the potential of the third terminal of the transistor active element in a row unit, and the luminance of the emitter in each column can be set by independently controlling the potential of the second terminal of the transistor active element of each emitter in a column unit. As a result, the diode emitting element making up each emitter can emit light with optimum efficiency.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display panel, comprising:

emitters disposed in the form of an array;

an active element, having a first terminal and a second terminal, which is adapted to switch between the first terminal and the second terminal;

a diode emitting element having a first terminal and a second terminal, wherein the diode emitting element is an organic EL; and a capacitor having a first terminal and a second temiinal, wherein;

the respective first terminal of the active element, the diode emitting element, and the capacitor are directly connected to one another at a common terminal, and the respective second terminals of the active element, the diode emitting element, and the capacitor are connected to connecting lines different from one another, and potentials are individually set for the respective second terminals of the active element, the diode emitting element, and the capacitor via the respective connecting lines, while controlling a switching operation of the active element, so as to control charning and discharging of the capacitor so that the diode emitting element emits light.

2. The display panel as set forth in claim 1, wherein:

the active element is a diode active element, and a forward direction of the diode emitting element and a forward direction of the diode active element coincide.

3. The display panel of claim 2, further comprising:

a control section for controlling the potentials for the respective second terminals of the diode active element, the diode emitting element, and the capacitor, wherein:

said control section operates to store charge in the capacitor by generating a potential difference between the second terminal of the diode active element and the second terminal of the capacitor so that a forward potential difference is generated in the diode active element, and said control section operates to vary a potential difference between the second terminal of the capacitor and the second terminal of the diode emitting element so that the stored charge in the capacitor is discharged via the diode emitting element, while generating a potential difference between the second terminal of the diode active element and the second terminal of the capacitor to generate a reverse potential difference in the diode active element.

4. A display panel, comprising:

emitters which are disposed in the form of an array, each of said emitters being the emitter of claim 2, the second terminal of the diode active element of one emitter being electrically connected to the second terminal of the diode active element of another emitter between the emitters in a column direction of the array, and the second terminal of the capacitor and the second terminal of the diode emitting element of one emitter being electrically connected to the second terminal of the capacitor and the second terminal of the diode emitting element of another emitter, respectively, between the emitters in a row direction of the array.

5. The display panel of claim 1, further comprising:

a control section for controlling the potentials set for the respective second terminals of the active element, the diode emitting element, and the capacitor, while controlling the switching operation of the active element, wherein:

said control section operates to store charge in the capacitor by generating a potential difference between the second terminal of the active element and the second terminal of the capacitor, while the active element is in a conduction state, and said control section operates to vary a potential difference between the second terminal of the capacitor and the second terminal of the diode emitting element, so as to discharge the stored charge in the capacitor via the diode emitting element, while the active element is in a non-conduction state.

6. The display panel as set forth in claim 5, wherein:

the diode emitting element emits light in tones, and said control section generates the potential difference between the second terminal of the active element and the second terminal of the capacitor so that the capacitor stores charge which is in accordance with a tone to be emitted by the diode emitting element.

7. The display panel as set forth in claim 6, wherein:

said control section controls the potential difference between the second terminal of the active element and the second terminal of the capacitor while monitoring a current which flows through the second terminal of the active element or the second terminal of the capacitor.

8. The display panel as set forth in claim 5, wherein:

said control section varies the potential difference between the second terminal of the capacitor and the second terminal of the diode emitting element, so that a current which flows through the diode emitting element becomes constant, when the capacitor discharges the stored charge.

9. The display panel as set forth in claim 1, wherein:

the active element is a transistor active element having a third terminal which is set to have a potential for controlling the switching between the first terminal and the second terminal.

10. A display panel, comprising:

emitters which are disposed in the form of an array, each of said emitters being the emitter of claim 9, the second terminal of the transistor active element of one emitter being electrically connected to the second terminal of the transistor active element of another emitter between the emitters in a column direction of the array, and the second terminal of the diode emitting element and the third terminal of the transistor active element of one emitter being electrically connected to the second terminal of the diode emitting element and the third terminal of the transistor active element of another emitter, respectively, between the emitters in a row direction of the array.

11. The display panel as set forth in claim 10, wherein the second terminal of the capacitor of one emitter is electrically connected to the second terminal of the capacitor of another emitter between the emitters.

12. A display panel, comprising:

emitters which are disposed in the form of an array, each of said emitters being the emitter of claim 9, the second terminal of the transistor active element of one emitter being electrically connected to the second terminal of the transistor active element of another emitter between the emitters in a column direction of the array, and the second terminal of the capacitor and the third terminal of the transistor active element of one emitter being electrically connected to the second terminal of the capacitor and the third terminal of the transistor active element of another emitter, respectively, between the emitters in a row direction of the array.

13. The display panel as set forth in claim 12, wherein the second terminal of the diode emitting element of one emitter is electrically connected to the second terminal of the diode emitting element of another emitter between the emitters.

14. The display panel of claim 9, further comprising:

a control section for controlling potentials which are respectively set for the respective second terminals of the transistor active element, the diode emitting element, and the capacitor, while controlling the switching operation of the transistor active element by controlling the potential set for the third terminal of the transistor active element, wherein:

said control section operates to set potentials respectively for the second terminal of the diode emitting element and the second terminal of the transistor active element, so as to generate a reverse potential difference in the diode emitting element, while the transistor active element is in a conduction state.

15. The display panel of claim 9, further comprising:

a control section for controlling the potentials set for the respective second terminals of the transistor active element, the diode emitting element, and the capacitor, while controlling the switching operation of the transistor active element by controlling the potential set for the third terminal of the transistor active element, wherein:

said control section operates to store charge in the capacitor by generating a potential difference between the second terminal of the active element and the second terminal of the capacitor, while the transistor active element is in a conduction state, and said control section operates to vary a potential difference between the second terminal of the capacitor and the second terminal of the diode emitting element, so as to discharge the stored charged in the capacitor via the diode emitting element, while the transistor active element is in a non-conduction state.

16. A display panel, comprising:

emitters which are disposed in the form of an array, each of said emitters being the emitter of claim 9, the second terminal of the capacitor or the second terminal of the diode emitting element of one emitter being electrically connected to the second terminal of the capacitor or the second terminal of the diode emitting element of another emitter, respectively, between the emitters.

17. A display panel, comprising:

a plurality of pixels which are disposed in the form of an array;

a first scanning electrode and a second scanning electrode which are provided corresponding to each row; and a signal electrode which is provided corresponding to each column, wherein:

each of said plurality of pixels includes: a diode active element, having a first terminal and a second terminal, which is adapted to switch between the first terminal and the second terminal; a diode emitting element having a first terminal and a second terminal; wherein the diode emitting elements is an organic EL; and a capacitor having a first terminal and a second terminal, and in each pixel, the respective first terminals of the diode active element, the diode emitting element, and the capacitor are directly connected to one another at a common terminal, and a forward direction of the diode emitting element and a forward direction of the diode active element coincide each other between the second terminal of the diode emitting element and the second terminal of the diode active element, and the signal electrode is connected to a signal side connecting line and is connected to the second terminal of the diode active element of a pixel of the corresponding column, and the first scanning electrode is connected to a first scanning side connecting line and is connected to the second terminal of the diode emitling element of a pixel of the corresponding row, and the second scanning electrode is connected to a second scanning side connecting line and is connected to the second terminal of the capacitor of a pixel of the corresponding row, and potentials are individually set for the respective second terminals of the active element, the diode emitting element, and the capacitor via the respective connecting lines, while controlling a switching operation of the active element, so as to control charging and discharging of the capacitor so that the diode emitting element emits light.

18. A display device, comprising:

the display panel of claim 17; and a control section for controlling the respective potentials of the first scanning electrode, the second scanning electrode, and the signal electrode, wherein:

said control section sets a potential for the signal electrode according to a tone to be displayed on each pixel of a selected row while successively selecting rows, and in the selected row, said control section controls respective potentials of the first scanning electrode and the second scanning electrode corresponding to the selected row to generate a forward potential difference in the diode active element of each pixel of the selected row, while generating a reverse potential difference in the diode emitting element of each pixel of the selected row, so as to store charge in the capacitor of each pixel of the selected row, according to a tone to be displayed on the pixel, and in a non-selected row, said control section controls a potential of the second scanning electrode corresponding to the non-selected row to vary a potential of the first scanning electrode, while generating a reverse potential difference in the diode active element of each pixel of the non-selected row, so as to discharge stored charge in the capacitor of each pixel of the non-selected row via the diode emitting element.

19. A display panel, comprising:

a plurality of pixels which are disposed in the form of an array;

a common electrode which is common to all of said plurality of pixels;

a first scanning electrode and the second scanning electrode which are provided corresponding to each row; and a signal electrode which is provided corresponding to each column, wherein:

each of said plurality of pixels includes: a transistor active element having a first terminal, a second terminal, and a third terminal, switching between the first terminal and the second terminal being controlled by a potential set for the third terminal; a diode emitting element having a first terminal and a second terminal, wherein the diode emitting element is an organic EL; and a capacitor having a first terminal and a second terminal, and in each pixel, the respective first terminals of the transistor active element, the diode emitting element, and the capacitor are directly connected to one another at a common terminal, the common electrode is connected to the second terminal of the capacitor of each pixel, the second scanning electrode is connected to a second scanning side connecting line and is connected to the third terminal of the transistor active element of a pixel of the corresponding row, the first scanning electrode is connected to a first scanning side connecting line and is connected to the second terminal of the diode emitting element of a pixel of the corresponding row, and the signal electrode is connected to a signal side connecting line and is connected to the second terminal of the transistor active element of a pixel of the corresponding row.

20. A display device, comprising:

the display panel of claim 19; and a control section for controlling respective potentials of the first scanning electrode, the second scanning electrode, and a signal electrode, wherein:

a constant potential is set for the common electrode, and said control section sets a potential for the signal electrode according to a tone to be displayed on each pixel of a selected row while successively selecting rows, and in the selected row, said control section controls a potential of the first scanning electrode corresponding to the selected row to conduct the transistor active element of each pixel of the selected row by controlling a potential of the second scanning electrode of the selected row, while generating a reverse potential difference in the diode emitting element of each pixel of the selected row, so as to store charge in the capacitor of each pixel of the selected row according to a tone to be displayed on the pixel, and in a non-selected row, said control section varies a potential of the first scanning electrode, while not conducting the transistor active element of each pixel of the non-selected row by controlling a potential of the second scanning electrode of the non-selected row, so as to discharge stored charge in the capacitor of each pixel of the non-selected row via the diode emitting element.

21. A display panel, comprising:

a plurality of pixels which are disposed in the form of an array;

a common electrode which is common to all of the plurality of pixels;

a first scanning electrode and a second scanning electrode which are provided corresponding to each row; and a signal electrode which is provided corresponding to each column, wherein:

each of said plurality of pixels includes: a transistor active element having a first terminal, a second terminal, and a third terminal, switching between the first terminal and the second terminal being controlled by a potential set for the third terminal; a diode emitting element having a first terminal and a second terminal, wherein the diode emitting element is an organic EL; and a capacitor having a first terminal and a second terminal, and in each pixel, the respective first terminals of the transistor active element, the diode emitting element, and the capacitor are connected to one another at a common terminal, the common electrode is connected to the second terminal of the diode emitting element of each pixel, the second scanning electrode is connected to a signal side connecting line and is connected to the third terminal of the transistor active element of a pixel of the corresponding row, the first scanning electrode is connected to a signal side connecting line and is connected to the second terminal of the capacitor of a pixel of the corresponding row, and the signal electrode is connected to a signal side connecting line and is connected to the second terminal of the transistor active element of a pixel of the corresponding row.

22. A display device, comprising:

the display panel of claim 21; and a control section for controlling respective potentials of the first scanning electrode, the second scanning electrode, and the signal electrode, wherein:

a constant potential is set for the common electrode, and said control section sets a potential, within a range for generating a reverse potential difference in the diode emitting element, for the signal electrode according to a tone to be displayed on each pixel of a selected row while successively selecting rows, and in the selected row, said control section conducts the transistor active element of each pixel of the selected row by controlling a potential of the second scanning electrode of the selected row, so as to store charge in the capacitor of each pixel of the selected row according to a tone to be displayed on the pixel, and in a non-selected row, said control section varies a potential of the first scanning electrode while not conducting the transistor active element of each pixel of the non-selected row by controlling a potential of the second scanning electrode of the non-selected row, so as to discharge stored charge in the capacitor of each pixel of the non-selected row via the diode emitting element.

* * * * *